US009752398B2

(12) United States Patent
Belik

(10) Patent No.: US 9,752,398 B2
(45) Date of Patent: Sep. 5, 2017

(54) APPARATUS AND METHOD FOR SERVICING PIPES

(71) Applicant: NATIONAL OILWELL VARCO, L.P., Houston, TX (US)

(72) Inventor: Jaroslav Belik, Smithville, TX (US)

(73) Assignee: National Oilwell Varco, L.P., Houston, TX (US)

( * ) Notice: Subject to any disclaimer, the term of this patent is extended or adjusted under 35 U.S.C. 154(b) by 110 days.

(21) Appl. No.: 14/061,537

(22) Filed: Oct. 23, 2013

(65) Prior Publication Data

US 2014/0110173 A1 Apr. 24, 2014

Related U.S. Application Data

(60) Provisional application No. 61/717,300, filed on Oct. 23, 2012.

(51) Int. Cl.

| | |
|---|---|
| ***E21B 19/00*** | (2006.01) |
| ***E21B 19/20*** | (2006.01) |
| ***B08B 9/023*** | (2006.01) |
| ***B24C 3/32*** | (2006.01) |
| ***B05D 7/22*** | (2006.01) |
| ***E21B 17/00*** | (2006.01) |

(52) U.S. Cl.
CPC ..... *E21B 19/20* (2013.01); *B05D 7/222* (2013.01); *B08B 9/023* (2013.01); *B24C 3/325* (2013.01); *E21B 17/006* (2013.01)

(58) Field of Classification Search
CPC ..... B08B 9/021; B08B 9/023; E21B 12/06; E21B 17/006; B24C 3/325; B05B 7/222
USPC ..... 134/198, 168 C, 167 C, 170; 118/318
See application file for complete search history.

(56) References Cited

U.S. PATENT DOCUMENTS

| | | | | |
|---|---|---|---|---|
| 2,451,635 | A * | 10/1948 | Schratt | B24C 3/325 118/306 |
| 4,508,577 | A * | 4/1985 | Conn | B08B 9/035 134/1 |
| 5,239,786 | A * | 8/1993 | Carpenter | B24C 3/325 451/38 |
| 5,474,097 | A | 12/1995 | Lowe et al. | |
| 6,125,864 | A * | 10/2000 | Morikawa | B08B 9/0826 134/167 R |

(Continued)

FOREIGN PATENT DOCUMENTS

| | | |
|---|---|---|
| DE | 2533952 A1 | 2/1977 |
| EP | 0124107 A2 | 4/1983 |
| EP | 2415528 A1 | 2/2012 |

OTHER PUBLICATIONS

UKIPO Search Report dated Apr. 8, 2014, for G.B. Patent Application No. 1318730.7.

(Continued)

*Primary Examiner* — Michael Wieczorek
*Assistant Examiner* — Kevin G Lee
(74) *Attorney, Agent, or Firm* — Conley Rose, P.C.

(57) ABSTRACT

An apparatus for servicing pipes includes a pipe holder having a frame configured to support the pipe and a movement assembly coupled to the frame and configured to rotate the pipe about a longitudinal axis of the pipe, and a first pipe servicing tool disposed proximate to an end of the pipe holder, where the first pipe servicing tool is configured to operably engage an end of the pipe when the pipe is rotated by the movement assembly.

23 Claims, 18 Drawing Sheets

(56) References Cited

U.S. PATENT DOCUMENTS

| | | | | |
|---|---|---|---|---|
| 6,447,366 | B1 * | 9/2002 | Ebadian | B24C 3/18 451/2 |
| 6,550,547 | B1 * | 4/2003 | Payne | E21B 19/20 175/24 |
| 8,061,296 | B1 | 11/2011 | Batur | |
| 8,113,762 | B2 | 2/2012 | Belik | |
| 2007/0031215 | A1 | 2/2007 | Belik | |
| 2013/0341013 | A1 * | 12/2013 | Flusche | E21B 7/02 166/250.15 |

OTHER PUBLICATIONS

Examination Report dated Apr. 6, 2017, for Patent Application No. GB1318730.7.

* cited by examiner

APPARATUS AND METHOD FOR SERVICING PIPES

CROSS-REFERENCE TO RELATED APPLICATION

This application claims the benefit of U.S. provisional patent applications Ser. No. 61/717,300 filed Oct. 23, 2012 and entitled "Apparatus and Method for Servicing Pipes."

STATEMENT REGARDING FEDERALLY SPONSORED RESEARCH OR DEVELOPMENT

Not applicable.

BACKGROUND

The present disclosure relates generally to drilling of wells. More particularly, the present disclosure relates to methods and apparatus for cleaning, lubricating and testing pipes.

At some point during the drilling of a well, there will be a reason to pull a drill string out of a well and then run it back in. This process is typically referred to as "tripping." The portion of the tripping involving pulling the drill string out of the well may be referred to as "tripping out," and the portion of the tripping involving running the drill string back into the well may be referred to as "tripping in." Tripping out involves breaking out pipe connections, whereas tripping in involves making up pipe connections. On some rigs, the breaking out and making up of pipe connections are between single drill pipes, as opposed to pipe stands, and a drill string.

During tripping out, the drill string is suspended in the well in slips. An elevator picks the drill string up from the slips and raises the drill string until a drill pipe at the top of the drill string is just above the slips. The slips then close. An iron roughneck is used to spin the drill pipe and break out the connection between the drill pipe and the drill string. A pipe handling system picks up the drill pipe, disconnecting the elevator from the drill pipe. The pipe handling system moves the drill pipe to a horizontal position on the ground. A forklift then picks the drill pipe from the pipe handling system and places the drill pipe in a horizontal rack on the ground. This process can be repeated for as many drill pipes as need to be separated from the drill string. The separated drill pipes can be arranged in multiple horizontal racks on the ground.

Tripping in starts with the drill pipes stored in horizontal racks on the ground. While the drill string is suspended in slips, a worker lubricates a box at the top of the drill string. A forklift moves a drill pipe from one of the horizontal racks to the pipe handling system, and the pipe handling system in turn moves the drill pipe to the well center. At the well center, an elevator picks up the drill pipe and stabs the drill pipe into the box. After the stabbing, an iron roughneck spins the drill pipe and makes up the connection between the drill pipe and the drill string. The elevator then lifts the drill string from the slips and lowers the drill string until the drill pipe is just above the slips. The slips close, and the elevator is disconnected from the drill pipe. This process can be repeated for as many drill pipes as need to be connected to the drill string.

In some cases, prior to connecting a drill pipe to the drill string, the pin and box of the drill pipe are cleaned. Typically, this cleaning is carried out while the drill pipe is in the vertical position. The cleaning of the drill pipe and lubrication of the box prior to making up the pipe connection lengthen the duration of the tripping in. Also, the vertical orientation of the drill pipe during the cleaning as well as time constraints on rig operations can make it difficult to achieve quality pipe cleaning and lubrication.

BRIEF SUMMARY OF THE DISCLOSURE

The present disclosure describes embodiments of apparatuses and methods for servicing pipes. In an embodiment, an apparatus for servicing pipes includes a pipe holder having a frame configured to support the pipe and a movement assembly coupled to the frame and configured to rotate the pipe about a longitudinal axis of the pipe, a first pipe servicing tool disposed proximate to an end of the pipe holder, wherein the first pipe servicing tool is configured to operably engage an end of the pipe when the pipe is rotated by the movement assembly. In this embodiment, the apparatus may also include an actuator coupled to the pipe holder and configured to selectively move the pipe holder between a horizontal position and an inclined position. The first pipe servicing tool may include a cleaning tool configured to deliver a cleaning fluid to an end of the pipe. The first pipe servicing tool may also include a lubrication tool configured to deliver lubricant to an end of the pipe. Further, the first pipe servicing tool may include a conductivity tester configured to test the conductivity of a conductor of the pipe.

In this embodiment, the first pipe servicing tool include a combination tool configured to lubricate the pipe and test the conductivity of a conductor of the pipe. The cleaning tool may include a nozzle coupled to an end of a retractable arm, wherein the nozzle is configured to apply a fluid to a surface of the pipe and an actuator coupled to the arm and configured to extend and retract the arm. The conductivity tester may include an actuator coupled to a retractable shaft and configured to extend and retract the shaft, a conductor coupled to an end of the shaft and configured to engage a conductor of the pipe and a shield configured to protect the conductivity tester from a collision with the pipe. The shield may be rotatable between a first position and a second position, wherein in the first position the shield is arranged to contact the pipe and wherein in the second position the shield is arranged to allow the conductor to engage the pipe. The combination tool may include a rotary actuator coupled to a first end of a shaft, wherein the actuator is configured to rotate the shaft, a conductor coupled to a second end of the shaft, wherein the conductor is configured to contact a conductor of the pipe and an electrical lead connected to the annular conductor and extending through the conduit of the shaft. Also, this embodiment may further include a second pipe servicing tool disposed proximal to the opposite end of the pipe from the first pipe servicing tool. The second pipe servicing tool may be selected from the group including of a cleaning tool, a lubrication tool and a combination tool.

In another embodiment, an apparatus for servicing pipes includes a pipe holder comprising, a frame configured to support the pipe and a movement assembly coupled to the frame configured to manipulate the pipe, and a first pipe servicing tool disposed proximate to an end of the pipe holder and configured to operably engage an end of the pipe, wherein the first pipe servicing tool and the movement assembly are configured to provide relative movement between the first pipe servicing tool and the pipe. The first pipe servicing tool and the movement assembly may be configured to provide relative rotational movement between the first pipe servicing tool and the pipe. The first pipe servicing tool and the movement assembly may also configured to provide relative axial movement between the first pipe servicing tool and the pipe. This embodiment may further include an actuator coupled to the pipe holder and configured to selectively move the pipe holder between a horizontal position and an inclined position.

In this embodiment, the first pipe servicing tool may include a conductivity tester configured to test the conductivity of a conductor of the pipe. The first pipe servicing tool may also include a combination tool configured to lubricate the pipe and test the conductivity of a conductor of the pipe. The cleaning tool may include a nozzle coupled to an end of a retractable arm, wherein the nozzle is configured to apply a fluid to a surface of the pipe and an actuator coupled to the arm and configured to extend and retract the arm. The conductivity tester may include an actuator coupled to a retractable shaft and configured to extend and retract the shaft, a conductor coupled to an end of the shaft and configured to engage a conductor of the pipe and a shield configured to protect the conductivity tester from a collision with the pipe. The shield may be rotatable between a first position and a second position, wherein in the first position the shield is arranged to contact the pipe and wherein in the second position the shield is arranged to allow the conductor to engage the pipe. Also, the combination tool may include a rotary actuator coupled to a first end of a shaft, wherein the actuator is configured to rotate the shaft, a conductor coupled to a second end of the shaft, wherein the conductor is configured to contact a conductor of the pipe and an electrical lead connected to the annular conductor and extending through the conduit of the shaft.

In another embodiment, a method for servicing pipes includes supporting a pipe in one of a horizontal position and an inclined position, disposing a pipe servicing tool proximal to an end of the pipe and operating the pipe servicing tool to perform a servicing at an end of the pipe, the servicing being selected from the group consisting of delivering cleaning fluid to the end of the pipe, delivering lubricant to the end of the pipe and testing the conductivity of a conductor of the pipe. This embodiment may also include transferring a pipe from a pipe storage system to a roller assembly via pivoting the pipe storage system relative to the roller assembly.

In another embodiment, an apparatus includes a pipe holder configured to support and rotate a pipe about an axis of the pipe. This embodiment also includes one or more pipe servicing tools disposed proximate to one or both of the ends of the pipe holder. The one or more pipe servicing tools may include a cleaning tool configured to deliver cleaning fluid to an end of the pipe, a lubrication tool configured to deliver lubricant to an end of a pipe and a conductivity tester tool configured to test the conductivity of a conductor. This embodiment further includes an actuator for selectively moving the pipe holder between a horizontal position and an inclined position.

In an embodiment, the apparatus further includes at least one translation device for moving at least one of the pipe servicing tools relative to the pipe holder and between a servicing position and a parking position. Two of the pipe servicing tools may be disposed proximate to the same end of the pipe holder and one of the pipe servicing tools is disposed proximate to a different end of the pipe holder.

In an embodiment, the apparatus further includes at least one translation device for selectively moving each of the pipe servicing tools disposed proximate to the same end of the pipe holder relative to the pipe holder and between a servicing position and a parking position. One of the pipe servicing tools may be disposed proximate to the same end of the pipe holder is a cleaning tool. The other of the pipe servicing tool may be disposed proximate to the same end of the pipe holder is a lubrication tool. Also, one of the pipe servicing tools may be disposed proximate to the different end of the pipe holder is a cleaning tool.

In an embodiment, at least one of the pipe servicing tools may have a cavity for receiving an end of a pipe. The pipe servicing tool having a cavity may be a cleaning tool, and the apparatus may further include a reservoir in communication with the cavity for draining fluid from the cavity. At least one of the pipe servicing tools may be a cleaning tool configured to deliver cleaning fluid through a nozzle. At least one of the pipe servicing tools may be a cleaning tool configured to selectively deliver cleaning fluid and drying fluid through at least one nozzle.

In an embodiment, the apparatus may further include a mounting base pivotally coupled to the pipe holder, and the actuator may be coupled to the pipe holder and the mounting base and operable to apply a push or pull force to the pipe holder to move the pipe holder between the horizontal and inclined positions. The pipe holder may include a pair of roller assemblies, and each of the roller assemblies may include a pair of roller units that are movable between an open position and a closed position. Each of the roller units may include a pair of rollers, and each of the roller assemblies may further include one or more drive motors for driving at least one of the rollers in each roller unit. The pipe holder may include a support arm with a pair of stands for mounting the pair of roller assemblies, and at least one of the stands may be movable to adjust a position of the roller assembly mounted thereto relative to a length of the support arm.

In an embodiment, the apparatus may further include a pair of pipe storage assemblies disposed on opposite sides of the pipe holder.

In an embodiment, the apparatus may further include a pair of pipe handling assemblies between the pipe storage assemblies and pipe holder for transferring pipes between the pipe storage assemblies and pipe holder.

In an embodiment, operation of the apparatus may be automated.

The present disclosure further describes methods of servicing pipes. In one aspect, a method includes supporting a pipe in one of a horizontal position and an inclined position. The pipe servicing method may further include arranging one or more pipe servicing tools at a servicing or parking position relative to one or both ends of the pipe. The method may further include operating at least one of the pipe servicing tools to perform a service at an end of the pipe, where the service may be selected from the group consisting of delivering cleaning fluid to the end of the pipe and delivering lubricant to the end of the pipe. The at least one pipe service tool may perform the service of delivering cleaning fluid to the end of the pipe, and the method may further include moving the pipe to the inclined position prior to performing the service of delivering cleaning fluid. The at least one pipe servicing tool may perform the service of delivering cleaning fluid to the end of the pipe, and the method may further include rotating the pipe during the operation of the at least one pipe servicing tool.

In an embodiment, the method may further include at least one of translating the at least one pipe servicing tool relative to the pipe or translating the pipe relative to the at least one pipe servicing tool such that the at least one pipe servicing tool is in a servicing position. The at least one pipe servicing tool may have a cavity, and translating the at least one pipe servicing tool or pipe is until an end of the pipe is received in the cavity.

In an embodiment, the method may further include operating two of the pipe servicing tools contemporaneously to perform the services of delivering cleaning fluid to opposite ends of the pipe.

In an embodiment, the method may further include moving the pipe to an inclined position prior to operating the two of the pipe servicing tools to perform the services of delivering cleaning fluid.

In an embodiment, the method may further include rotating the pipe during operating the two of the pipe servicing tools to perform the services of delivering cleaning Two of the pipe servicing tools may be operated to perform the services of delivering cleaning fluid and lubricant to the same end of the pipe, and the method may further include sequentially positioning the two of the pipe servicing tools at servicing positions at the same end of the pipe. Two of the pipe servicing tools may perform the services of delivering cleaning fluid to opposite ends of the pipe and one of the pipe servicing tools may perform the service of delivering lubricant to one of the ends of the pipe, and the service of delivering lubricant may be performed after completion of the services of delivering cleaning fluid.

In an embodiment, the method may further include moving the pipe to the inclined position prior to performing the services of delivering cleaning fluid and moving the pipe to the horizontal position prior to performing the service of delivering lubricant. At least one of the pipe servicing tools may perform the service of delivering cleaning fluid, and the method may further include draining fluid from the at least one of the pipe servicing tools performing the service of delivering cleaning fluid into a reservoir.

In an embodiment, at least one of the pipe servicing tools may perform the service of delivering cleaning fluid, and the method may further include operating the at least one of the pipe servicing tools to perform the service of drying an end of the pipe to which the cleaning fluid was delivered.

In an embodiment, the method may further include repeating the supporting the pipe, the arranging of the one or more pipe servicing tools, and the operating of the at least one of the pipe servicing tools for a plurality of pipes.

The present disclosure further describes a method of tripping in a drilling operation. In one aspect, the method may include separating one or more dirty pipes from a drill string suspended in the well and transporting the dirty pipes to an apparatus configured to clean and/or lubricate ends of the dirty pipes in a non-vertical position. The method may further include operating the apparatus to clean and/or lubricate the dirty pipes and transporting the clean and/or lubricated pipes to a storage area for later use.

It is to be understood that both the foregoing general description and the following detailed description are exemplary of the disclosure and are intended to provide an overview or framework for understanding the nature and character of the disclosure as it is claimed. The accompanying drawings are included to provide a further understanding of the disclosure and are incorporated in and constitute a part of this specification. The drawings illustrate various embodiments of the disclosure and together with the description serve to explain the principles and operation of the disclosure.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
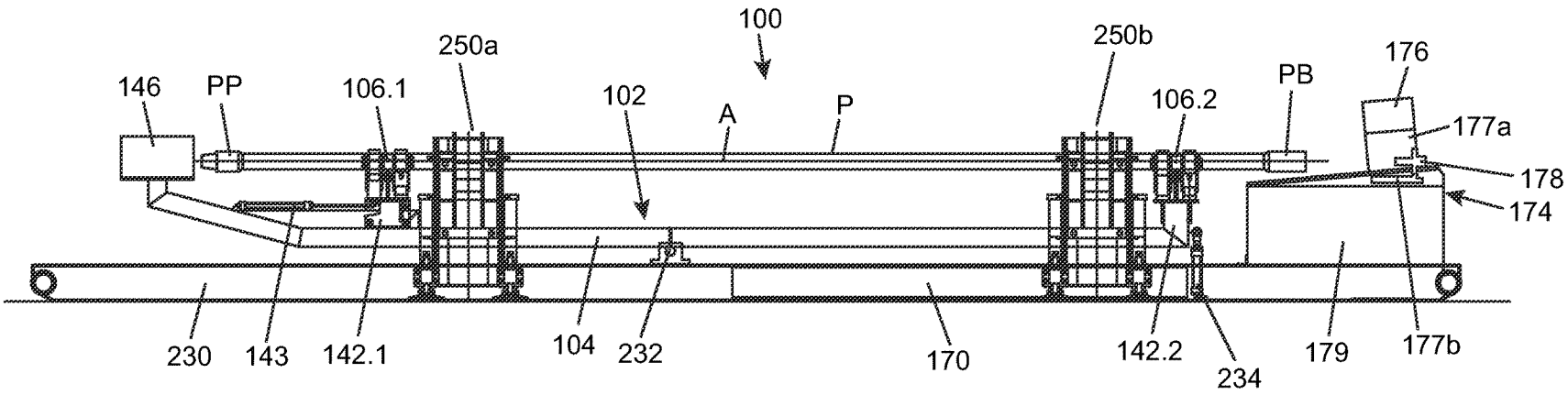
FIG. 1 is a top view of an apparatus for servicing pipes.

In the following detailed description, numerous specific details may be set forth in order to provide a thorough understanding of various embodiments of the disclosure. However, it will be clear to one skilled in the art when embodiments of the disclosure may be practiced without some or all of these specific details. In other instances, well-known features or processes may not be described in detail so as not to unnecessarily obscure the disclosure. In addition, like or identical reference numerals may be used to identify common or similar elements.

An apparatus 100 for servicing pipes is shown in FIG. 1. The apparatus 100 can be used to clean and/or lubricate pipes. The apparatus 100 includes a pipe holder 102 that supports and rotates a pipe P about a longitudinal or central pipe axis A. Typically, the pipe will have a box, i.e., an internal (female) threaded end, and a pin, i.e., an external (male) threaded end. The term "pipe" herein refers to any tubular good that may be used in connection with performing operations in an oil or gas well, e.g., drill pipes, drill collars, and casings.

In one embodiment, the pipe holder 102 includes a support arm 104 and two movement or roller assemblies 106.1, 106.2 mounted in spaced-apart relation on the support arm 104, where each roller assembly 106.1 and 106.2 are configured to manipulate the pipe. The roller assemblies 106.1, 106.2 are responsible for engaging and rotating the pipe P. The roller assembly 106.1 will be described in detail below. The roller assembly 106.2 would typically have the same structure as, or equivalent structure to, the roller assembly 106.2 and hence will not be described in detail separately.

Figure 2A:
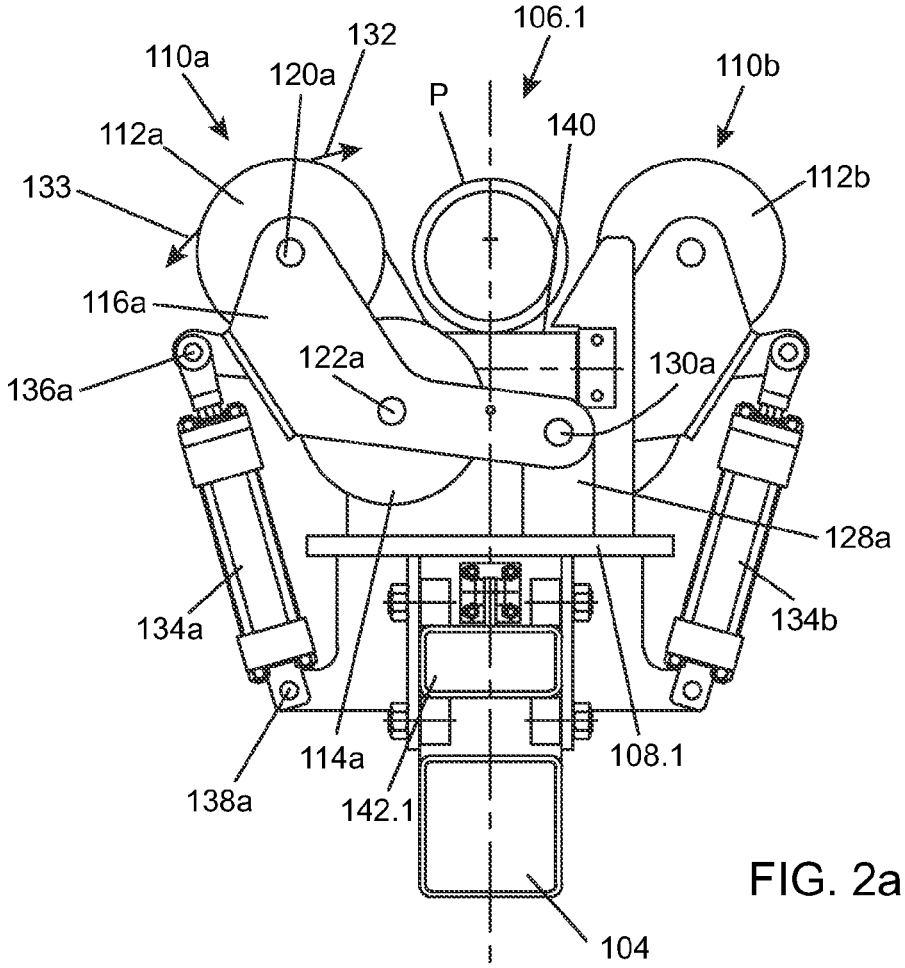
FIG. 2*a* shows a roller assembly for engaging and rotating a pipe.

In one embodiment, as shown in FIG. 2*a*, the roller assembly 106.1 includes a roller frame 108.1. The roller assembly 106.1 further includes roller units 110*a*, 110*b* mounted on opposite sides of the frame 108.1. The roller unit 110*a* will be described in detail below. The roller unit

110*b* would typically have the same structure as the roller unit 110*a* and hence will not be described in detail separately.

Figure 2B:
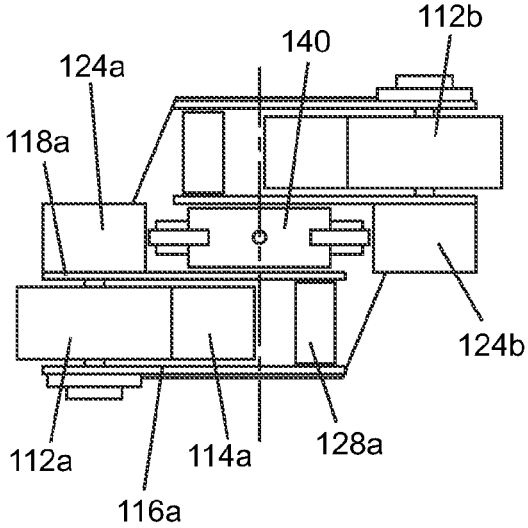
FIG. 2*b* shows a top view of the roller assembly of FIG. 2*a;*

In one embodiment, as shown in FIG. 2*a*, the roller unit 110*a* includes paired rollers 112*a*, 114*a* nested between parallel roller arms 116*a*, 118*a* (see 118*a* in FIG. 2*b*). The rollers 112*a*, 114*a* are supported on shafts 120*a*, 122*a*, respectively, which are coupled to the roller arms 116*a*, 118*a*, respectively. The rollers 112*a*, 114*a* are allowed to rotate on the shafts 120*a*, 122*a*, respectively. A drive motor 124*a* (see 124*a* in FIG. 2*b*) is coupled to the outer roller 112*a* and can be used to rotate the outer roller 112*a* on the shaft 120*a*, while the bottom roller 114*a* is allowed to spin freely on the shaft 122*a*. Typically, there will be no contact between the rollers 112*a*, 114*a*.

In one embodiment, lower ends of the roller arms 116*a*, 118*a* are coupled to a shaft 130*a*, which is arranged to rotate in a bearing 128*a* disposed between the roller arms 116*a*, 118*a*. The bearing 128*a* is integrated with or otherwise attached to the frame 108.1. By this arrangement, the roller arms 116*a*, 118*a* are pivotally coupled to the frame 108.1. Other methods of pivotally coupling the roller arms 116*a*, 118*a* to the frame 108.1 besides a shaft and bearing may be alternately used.

An actuator 134*a* is configured to selectively apply a push or pull force to the roller arms 116*a*, 118*a* (see 118*a* in FIG. 2*b*). In one embodiment, one end of the actuator 134*a* is coupled to the upper ends of the roller arms 116*a*, 118*a* at a pivot joint 136*a*, and another end of the actuator 134*a* is coupled to the frame 108.1 at a pivot joint 138*a*. Typically, the actuator 134*a* will be a linear actuator, such as a fluid-powered cylinder. In general, the actuator 134*a* may be any actuator, linear or otherwise, configured to selectively apply push and pull forces to the roller arms 116*a*, 118*a* such that the roller arms 116*a*, 118*a* pivot on the shaft 130*a*.

When the actuator 134*a* applies a push force to the roller arms 116*a*, 118*a*, the roller unit 110*a* pivots on the shaft 130*a* towards the center of the frame 108.1, as indicated by the arrow 132. Conversely, when the actuator 134*a* applies a pull force to the roller arms 116*a*, 118*a*, the roller unit 110*b* pivots on the shaft 130*a* away from the center of the frame 108.1, as indicated by the arrow 133. In the embodiment where the actuator 134*a* is a linear actuator, the actuator 134*a* may apply a push force to the roller unit 110*a* when extended and a pull force when retracted.

A mounting roller 140 is supported on the frame 108.1 in a manner that allows the roller 140 to rotate relative to the frame 108.1. The roller units 110*a*, 110*b* are disposed on opposite sides of the frame 108.1 such that the mounting roller 140 is between the roller units 110*a*, 110*b*. The plane in which the rollers 112*a*, 114*a* of the roller unit 110*a* rotate will generally be parallel to the plane in which the rollers 112*b*, 114*b* of the roller unit 110*b* rotate. The mounting roller 140 is configured to rotate in a plane that is transverse to the planes in which the rollers of the roller units 110*a*, 110*b* rotate. In other words, the mounting roller 140 is disposed crosswise relative to the rollers 112*a*, 114*a*, 112*b*, 114*b* (or the roller units 110*a*, 110*b*).

The roller units 110*a*, 110*b* can be rotated outwardly to the open position, in the direction shown by the arrow 132, to allow the pipe P to be placed on the mounting roller 140. While the roller units 110*a*, 110*b* are in the open position, the pipe P can slide on the mounting roller 140 and relative to the roller assembly 106.1. This motion can be used to adjust the position of the pipe P along the length of the support arm 104 (see 104 in FIG. 1). The roller units 110*a*, 110*b* can be rotated inwardly to the closed position, in the direction shown by the arrow 133, to engage the outer diameter of the pipe P placed on the mounting roller 140. The actuators 134*a*, 134*b* apply the necessary force to rotate the roller units 110*a*, 110*b*, respectively, between the open and closed positions.

Figure 2C:
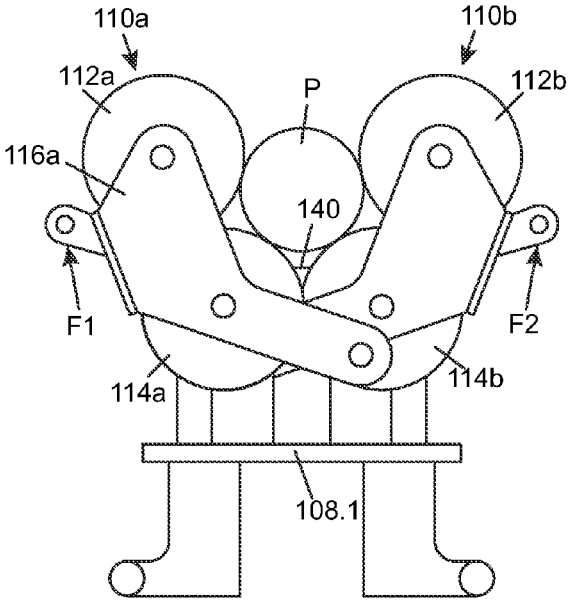
FIG. 2*c* shows a roller assembly in a closed position.

FIG. 2*c* shows the roller units 110*a*, 110*b* in the closed position, where the pipe P is nested between the rollers 112*a*, 114*a* and 112*b*, 114*b* of the roller units 110*a*, 110*b*, respectively. As part of engaging the pipe P, the roller units 110*a*, 110*b* have lifted the pipe P off the mounting roller 140. Forces F1, F2 applied by the actuators 134*a*, 134*b* (see 134*a*, 134*b* in FIG. 2*a*) will maintain the roller units 110*a*, 110*b* in the closed position until it is desired to release the pipe P. When the pipe P is nested between the roller units 110*a*, 110*b*, the drive motors 124*a*, 124*b* (see 124*a*, 124*b* in FIG. 2*b*) can be operated to rotate the outer rollers 112*a*, 112*b*, which will result in torque being applied to the pipe P to rotate the pipe P between the roller units 110*a*, 110*b*.

In FIG. 1, the roller assemblies 106.1, 106.2 are mounted on stands 142.1, 142.2, respectively, on support arm 104. In one embodiment, the stand 142.1 (also shown in FIG. 2*a*) can be rolled or moved along the support arm 104. An actuator 143 coupled to the stand 142.1 can be used to selectively apply the necessary force to move the stand 142.1 along the support arm 104. The movable stand 142.1 will allow the position of the roller assembly 106.1 to be adjustable along the support arm 104. The stand 142.2 will typically be fixed to the support arm 104, although it may be replaced with a movable stand in alternate embodiments if desired. A pipe P is loaded on both of the roller assemblies 106.1, 106.2. The roller assembly 106.1 is responsible for engaging one end of the pipe P, and the roller assembly 106.2 is responsible for engaging another end of the pipe P. After the roller assemblies 106.1, 106.2 have engaged the pipe P, the roller assemblies 106.1, 106.2 can be operated simultaneously to rotate the pipe P about the central pipe axis A.

A pipe servicing or cleaning tool 146 is disposed proximate to one end of the pipe holder 102 and is configured to operably engage a proximate end of the pipe. For example, the cleaning tool 146 is integrally mounted at the end of the support arm 104 near the roller assembly 106.1. The mounting of the cleaning tool 146 on the support arm 104 is such that the cleaning tool 146 is aligned with the roller assembly 106.1. Thus the cleaning tool 146 will be able to perform a cleaning servicing on an end of the pipe P while the pipe P is supported and engaged by the roller assemblies 106.1, 106.2. In this manner, the cleaning tool 146 is operably engaged with the pipe pin PP of pipe P. In one embodiment, the cleaning tool 146 is configured to clean the pin PP of the pipe P. Before operating the cleaning tool 146 to clean the pin PP, the roller assembly 106.1 is placed in the closed position and the roller assembly 106.2 is placed in the open position. The actuator 143 is then retracted to slide the pin PP into a cavity of the cleaning tool 146. The pipe P will slide on the mounting roller (similar to mounting roller 140 in FIG. 2*b*) of the roller assembly 106.2 as the pin PP slides into the cleaning tool. In this manner, the cleaning tool 146 is operably engaged with the pipe pin PP of pipe P. The pin PP may remain in the cleaning tool 146 until it is desired to unload the pipe P from the pipe holder 102.

Figure 3A:
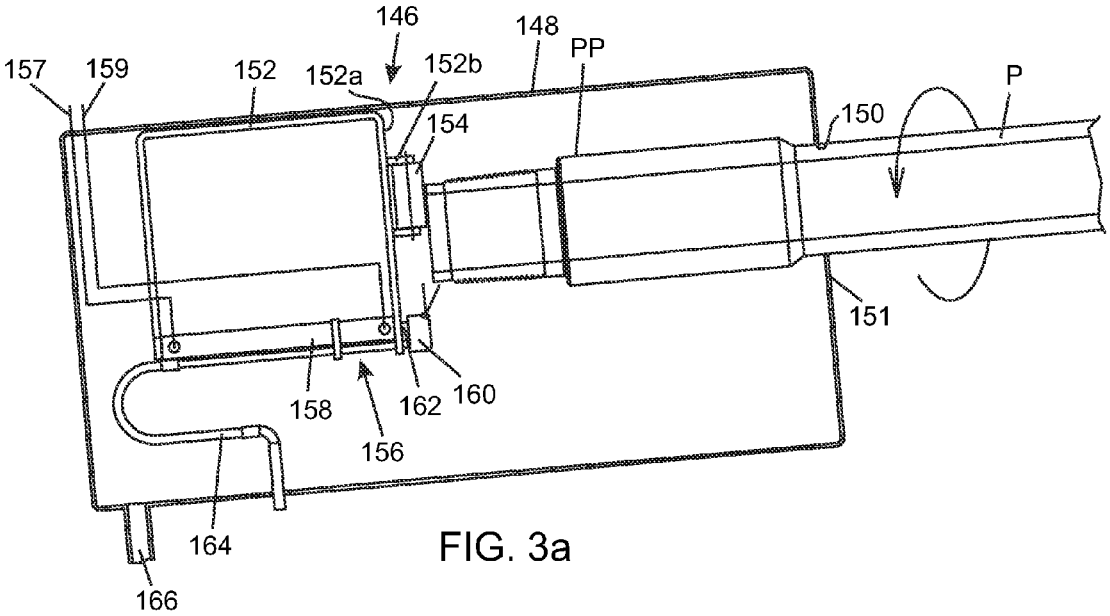
FIG. 3*a* shows a cleaning tool for a pin before cleaning.

The cleaning tool 146 can have any suitable configuration to achieve cleaning of the pin PP. In one embodiment, as shown in FIG. 3*a*, the pin cleaning tool 146 includes a container 148 with a front opening 150 through which the pin PP of the pipe P can be received inside the cavity of the container 148. A bracket 152 is secured inside the container 148. The bracket 152 has a front wall 152*a*, which would be in opposing relation to a face of the pipe pin PP when inserted through the front opening 150. A gasket 151 may be mounted in the front opening 150. The gasket 151 may be flexible to allow the large-diameter portion of the pipe pin PP to be inserted into the container 148 and to seal against the pipe P once the pipe pin PP has been inserted into the container 148.

A mechanical stop 154 is mounted on the front wall 152*a* by means of support 152*b* and pin (not shown) such that the mechanical stop 154 is rotatable in the plane of the front wall 152*a*. The mechanical stop 154 may be in the form of a disc or other suitable structure. The mechanical stop 154 may come into contact with the face of the pin PP. Therefore, to prevent damage to the face of the pin PP, the mechanical stop 154 may be made of a material that is softer than that of the pin PP.

A nozzle assembly 156 is attached to the bracket 152. The nozzle assembly 156 includes an actuator 158, which is powered via fluid lines 157, 159. A nozzle 160 is attached to a retractable arm 162 of the actuator 158. The arm 162 can be extended or retracted in a direction substantially perpendicular to the front wall 152*a* of the bracket 152 such that the nozzle 160 is positioned at various distances relative to the front wall 152*a*. The nozzle 160 will spray or apply a cleaning fluid all over the threads of the pipe pin PP received through the front opening 150. In this manner, the cleaning tool 146 is operably engaged with the pipe pin PP of pipe P.

Figure 3B:
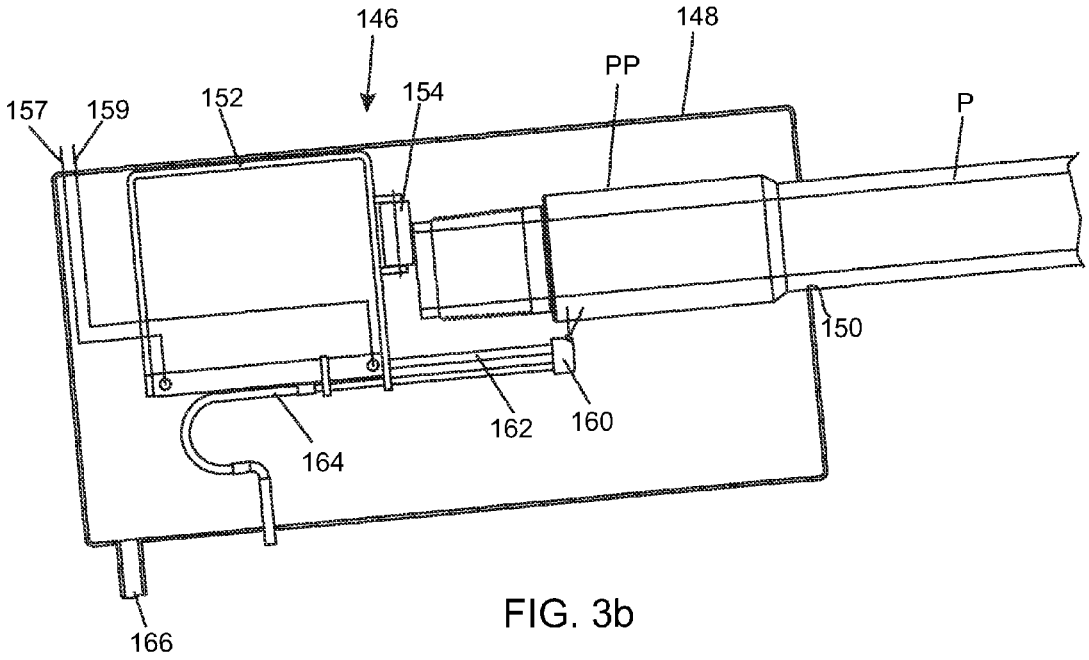
FIG. 3*b* shows a cleaning tool for a pin after cleaning.

FIG. 3*b* shows an extended position of the nozzle 160, which may correspond to the position of the nozzle at the end of the cleaning. A fluid line 164 supplies pressurized cleaning fluid, typically water, to the nozzle 160. The pressure of the supplied fluid can be set to achieve a desired cleaning pressure on the pipe pin PP. After cleaning the pin PP, the pin PP can be dried. The same nozzle 160, or a different nozzle, can be used to supply drying fluid, typically air or other gas, to the pin PP.

The container 148 has a port 166 for draining cleaning fluid out of the container 148. The cleaning fluid drained out of the container 148 will come in part from the nozzle 160 and in part from inside the bore of the pipe P. The fluid from inside the pipe P will be due to cleaning of the box of the pipe by another cleaning tool, which will be described later. The port 166 will be connected to a reservoir 170 (see 170 in FIG. 1) located below the pipe holder 102 (see 102 in FIG. 1). The reservoir 170 may include means such as filters and fluid conditioners to clean the dirty fluid received from the container 148. The cleaned fluid may then be recycled through the system.

In FIG. 1, a station 174 is located proximate to an end of the pipe holder 102. For example, the station 174 is located adjacent to the end of the support arm 104 near the roller assembly 106.2. The station 174 includes a pipe servicing or cleaning tool 176, a lubrication tool 178, and a control unit 179, where tools 176 and 178 are configured to operably engage a proximate end of the pipe. The cleaning tool 176 and lubrication tool 178 are mounted on translation devices 177*a*, 177*b*, respectively, which may be operated to position the cleaning tool 176 and lubrication tool 178 where they can perform services at an end of the pipe P while the pipe P is supported on the roller assemblies 106.1, 106.2. In this manner, the cleaning tool 176 and lubrication tool 178 are operably engaged with an end of the pipe P. The translation devices 177*a*, 177*b* can also return the cleaning tool 176 and lubrication tool 178 to their parking positions. The translation devices may be linear translation stages, XY linear translation stages, and the like. Station 174 may either be separate from or formed integrally with pipe holder 102.

Typically, only one of the cleaning tool 176 and lubrication tool 178 will be in a position to perform a servicing at an end of the pipe P at any given time. In one embodiment, the cleaning tool 176 and lubrication tool 178 are configured to perform cleaning and lubrication services, respectively, to the box PB of the pipe P and may have any suitable configurations to achieve their functions. In this manner, the cleaning tool 176 and lubrication tool 178 are operably engaged with the box PB of pipe P. The control unit 179 contains the necessary systems for operating the cleaning tools 146, 176 and lubrication tool 178. For example, the control unit 179 may contain hydraulic power unit, high pressure water pump, control system, and lubrication dosing system.

Figure 4A:
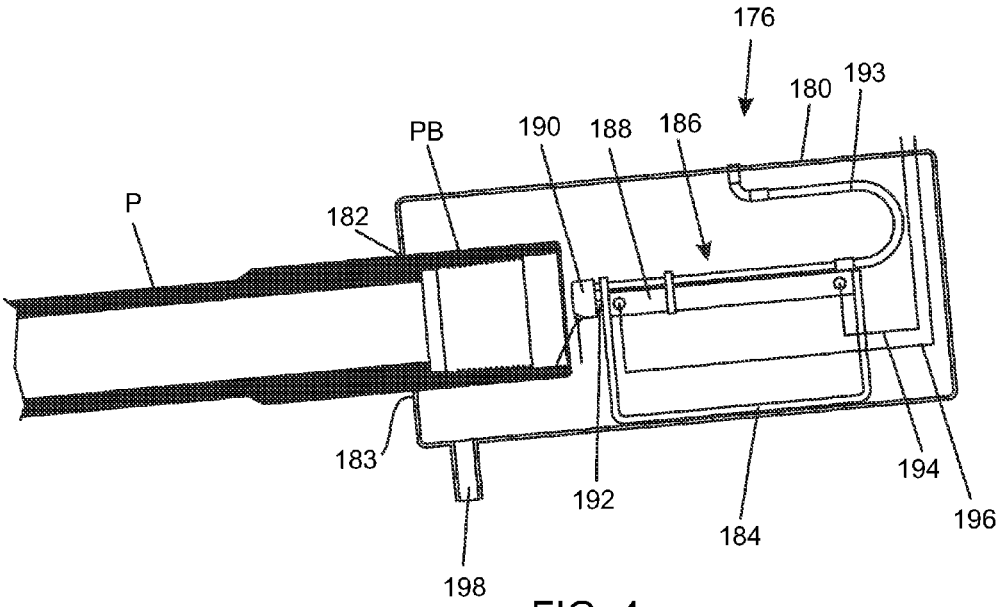
FIG. 4*a* shows a cleaning tool for a box before cleaning.

In FIG. 4*a*, in one embodiment, the cleaning tool 176 has a container 180 with a front opening 182 through which a box PB of pipe P may be received inside the cavity of the container. A gasket 183 may be mounted in the opening 182 to seal against the pipe box PB. A bracket 184 is mounted inside the container 180. The bracket 184 supports a nozzle assembly 186, which includes an actuator 188 that is powered via fluid lines 194, 196. A nozzle 190 is attached to an extension arm 192 of the actuator 188, and pressurized cleaning fluid is provided to the nozzle 190 via a fluid line 193. The container 180 has a port 198 through which cleaning fluid can be drained into the reservoir 170 (see 170 in FIG. 1).

Figure 4B:
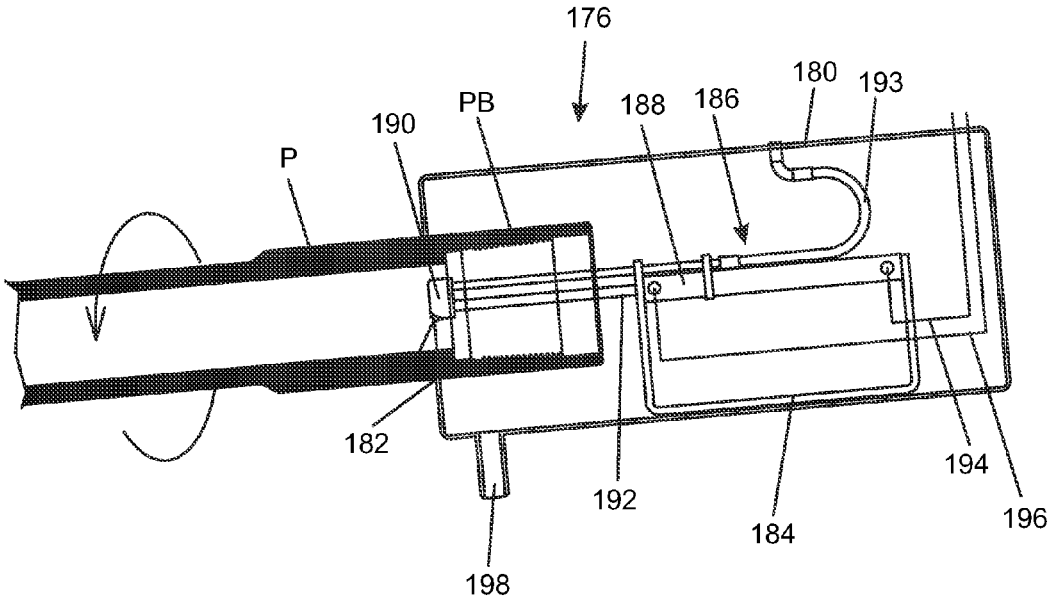
FIG. 4*b* shows a cleaning tool for a box after cleaning.

The cleaning tool 176 cleans by extending the nozzle 190 into the pipe box PB using the actuator 188 and operating the nozzle 190 to spray cleaning fluid, typically water, inside the pipe box PB. In this manner, the cleaning tool 176 is operably engaged with the pipe box PB of pipe P. FIG. 4*b* shows the nozzle 190 at an extended position inside the pipe box PB. The pressure of the cleaning fluid supplied through the fluid line 193 can be adjusted to achieve a desired cleaning pressure inside the pipe box PB. After cleaning, the pipe box PB may be dried. The nozzle 190, or another nozzle, can be used to supply drying fluid, typically air, to the box PB. In this manner, the cleaning tool 176 is operable engaged with the pipe box PB of pipe P.

Figure 5:
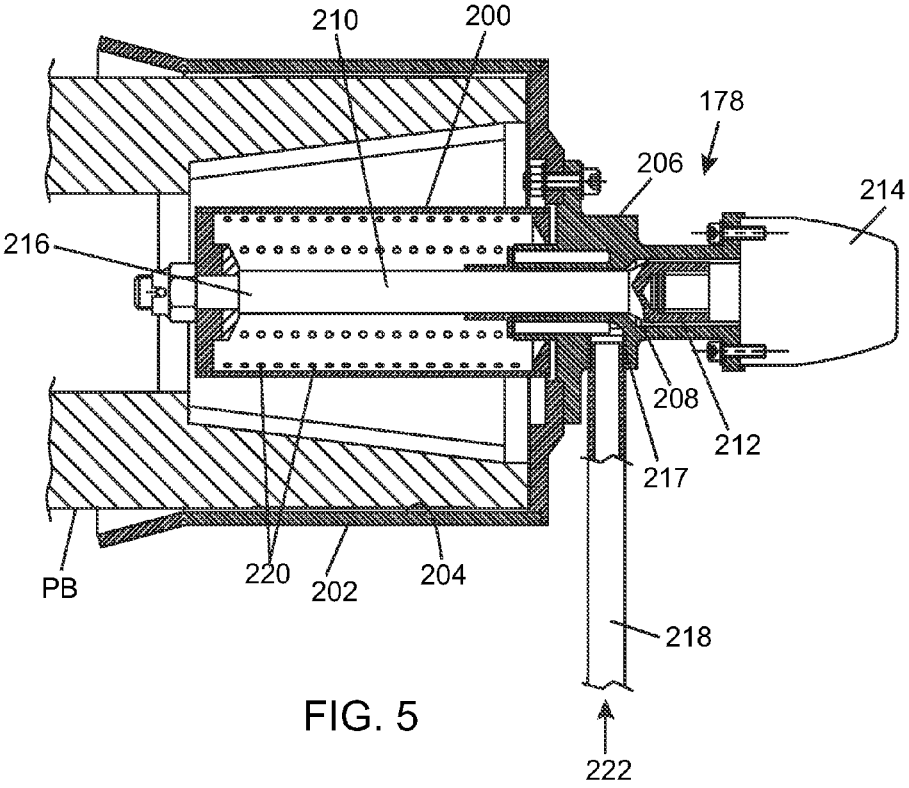
FIG. 5 shows a lubrication tool in a servicing position.
Figure 6A:
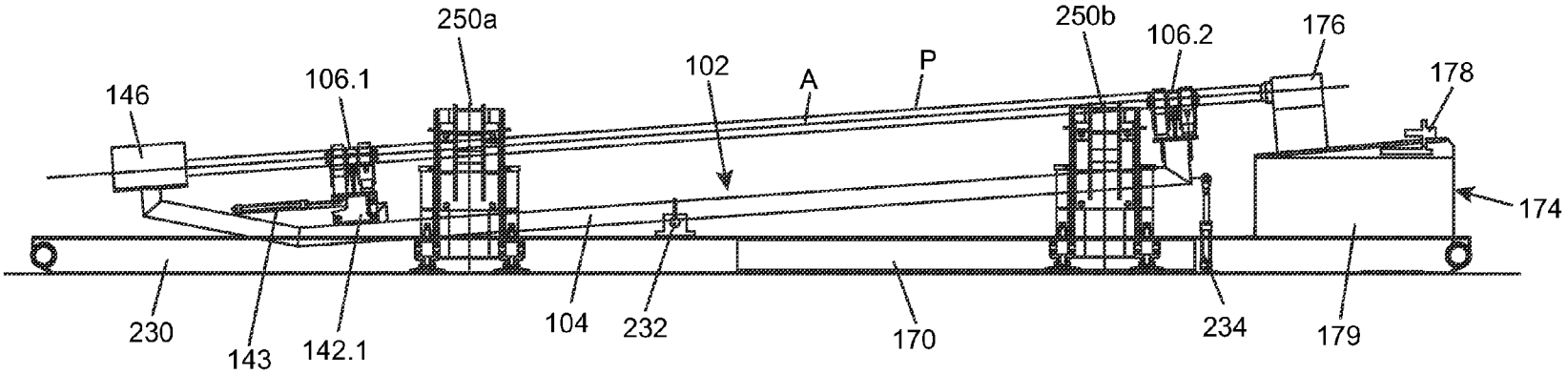
FIG. 6*a* shows a pipe being cleaned in an inclined position.
Figure 6B:
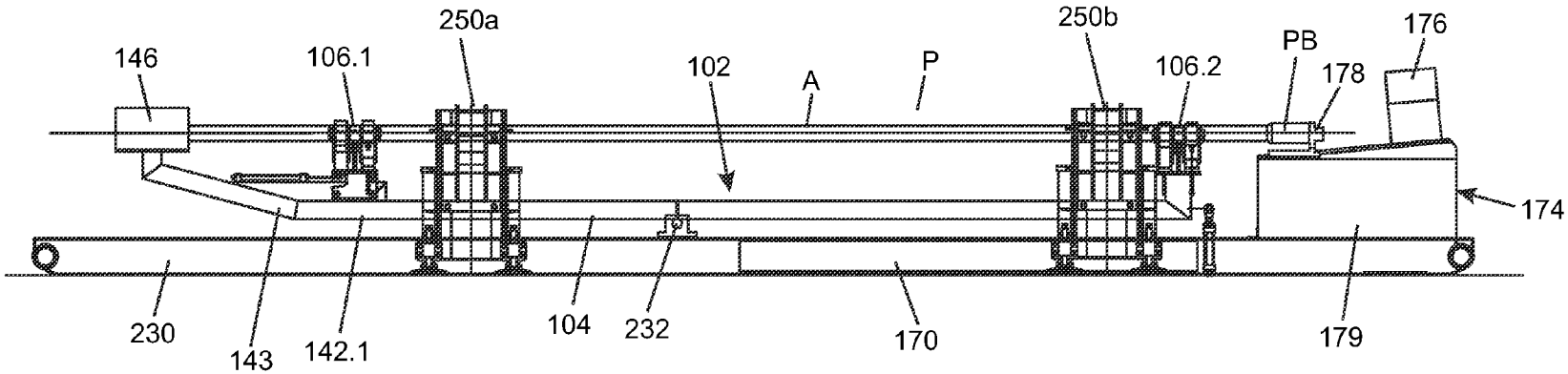
FIG. 6*b* shows a pipe being lubricated in a horizontal position.

In FIG. 5, in one embodiment, the lubrication tool 178 has a drum 200 disposed inside a generally cylindrical housing 202. The drum 200 is of smaller diameter than the housing 202 such that an annulus 204 is defined between them. The annulus 204 is large enough to receive the wall of pipe box PB. At one end of the housing 202 is a cap 206, which has a conduit 208 that runs into the inside of the drum 200. A shaft 210 is inserted into the drum 200 through the conduit 208. The upper end 212 of the shaft 210 is coupled to a rotary actuator 214 above the cap 206. The rotary actuator 214 may be an electrical motor or any other actuator capable of rotating the shaft 210. The end 216 of the shaft 210 is coupled to the drum 200 in a manner that allows the shaft 210 to be rotated within the drum 200.

The cap 206 has a port 217 that is in communication with the inside of the drum 200 and through which lubricant or "dope" 222 can be delivered to the inside of the drum 200. A tubing 218 couples the port 217 to a lubricant source (not shown). The drum 200 is perforated or has pores 220. Lubricant 222 received inside the drum 200 is distributed about the drum 200 and squeezed out of the pores 220 of the drum 200 via centrifugal force, which is provided by rotation of the shaft 210. In use, the lubrication tool 178 is axially aligned with the pipe box PB. The lubrication tool 178 is then advanced towards the pipe box PB until the pipe box PB fits into the annulus 204 and the housing 202 abuts the rim of the pipe box PB. The thread of the pipe box PB will be in opposing relation to the drum 200 and will be lubricated via centrifugal force, as described above. In this manner, the lubrication tool 178 is operably engaged with the pipe box PB of pipe P.

In FIG. 1, the apparatus 100 further includes a mounting base 230 below the pipe holder 102. The earlier mentioned reservoir 170 may be located in the mounting base 230. The support arm 104 of the pipe holder 102 is coupled to the mounting base 230 at a pivot joint 232. An actuator 234 has one end coupled to the mounting base 230 and another end coupled to the support arm 104. The actuator 234 is operable to apply a push or pull force to the support arm 104 to move the support arm 104 between a horizontal position and an inclined position. The inclined position is favored when cleaning services are performed on the pipe P supported on the roller assemblies 106.1, 106.2 of the pipe holder 102. The actuator 234 may be a fluid-powered cylinder or other type of actuator that can be configured to apply a push or pull force to the support arm 104 in order to change the position of the support arm 104 between the horizontal and the inclined.

At the start of a cleaning and lubrication process, the support arm 104 is typically in a horizontal position. The roller assemblies 106.1, 106.2 are in the open position. The cleaning tool 176 and the lubrication tool 178 are in the retracted position. The actuator 143 is in the extended position. To start the cleaning process, the pipe P is loaded onto the mounting rollers coupled to the frames of the roller assemblies 106.1, 106.2. The roller assembly 106.1 is moved to the closed position, where the roller units of the roller assembly 106.1 engage the pipe P. The actuator 143 is then retracted to slide the pin PP of the pipe P into the cleaning tool 146. In this manner, the lubrication tool 146 is operably engaged with the pin PP of pip P.

After the pin PP is in the cleaning tool 146, the support arm 104 is moved to the inclined position by extending the actuator 234. The roller assembly 106.2 is then moved to the closed position, where the roller units of the roller assembly 106.2 engage the pipe P. The retraction of the actuator 143 may be such that the face of the pin PP abuts the mechanical stop 154 in the cleaning tool 146. Alternately, the roller assembly 106.1 may be moved to the open position before the support arm 104 is inclined such that the pipe P slides by gravity until the face of the pin PP abuts the mechanical stop 154. Also, it is possible that both the roller assemblies 106.1, 106.2 are in the closed position when moving the support arm 104 from the horizontal position to the inclined position.

While the pipe P is inclined, the cleaning tool 176 is advanced to the servicing position where it can perform a cleaning servicing at the box PB of the pipe P. In one embodiment, this involves sliding the cleaning tool 176 until the pipe box PB is received inside the cleaning tool 176. After the cleaning tool 176 is in the servicing position, the drive motors of the roller units of the roller assemblies 106.1, 106.2 are operated to rotate the pipe P. While the pipe P is being rotated, the cleaning tools 146, 176 are operably engaged with an end of the pipe P to clean the pin PP and box PB of the pipe P. During the cleaning, dirty fluid is collected in the reservoir 170. After the cleaning, the cleaning tools 146, 176 may also dry the pin PP and box PB of the pipe P, respectively.

When the cleaning and drying of the pin PP and box PB have been completed, rotation of the pipe P is stopped. The cleaning tool 176 is then moved to the parking position, and the support arm is returned to the horizontal position by retracting the actuator 234. In this manner, the cleaning tool 176 is operable disengaged with the pipe box PB of pipe P. In the inclined position of the pipe P, the lubrication tool 178 is advanced to the servicing position to operably engage and perform a lubrication service at the box PB of the pipe P. During the lubrication servicing, the lubrication tool 178 delivers lubricant to the threads of the box PB. The lubricant may be delivered by centrifugal force or by other means known in the art.

After the lubrication servicing has been completed, the lubrication tool 178 is moved to the parking position. In this manner, the lubrication tool is operably disengaged with the pipe box PB of pipe P. Next, the roller assembly 106.2 is moved to the open position so that the pipe P may slide relative to the roller assembly 106.2 on the mounting roller coupled to the frame of the roller assembly 106.2. The roller assembly 106.1 remains in the closed position. The actuator 143 is then retracted to slide the pin PP of the pipe P out of the cleaning tool 146. After the pin PP is out of the cleaning tool 146, the roller assembly 106.1 can be moved to the open position. The pipe P, which now has the clean pin PP and clean and lubrication box PB, can be removed from the pipe holder 102.

Although not shown in the drawings, a cleaning device may be mounted above the pipe holder 102 and deployed to clean the body of the pipe P while the pipe P is supported on the roller assemblies 106.1, 106.2, and possibly while the pipe P is being rotated.

The process of cleaning and lubricating a pipe described above can be automated, where the control unit 179 can issue the necessary commands to operate the positioning of the pipe P and the operation of the cleaning tools 146, 176 and lubrication tool 178. An operator with a remote control may also issue the necessary commands instead of the control unit 179. Automation of the cleaning and lubrication servicing can include automated loading of a pipe onto the roller assemblies 106.1, 106.2 and automated unloading of the pipe from the roller assemblies 106.1, 106.2.

Figure 7:
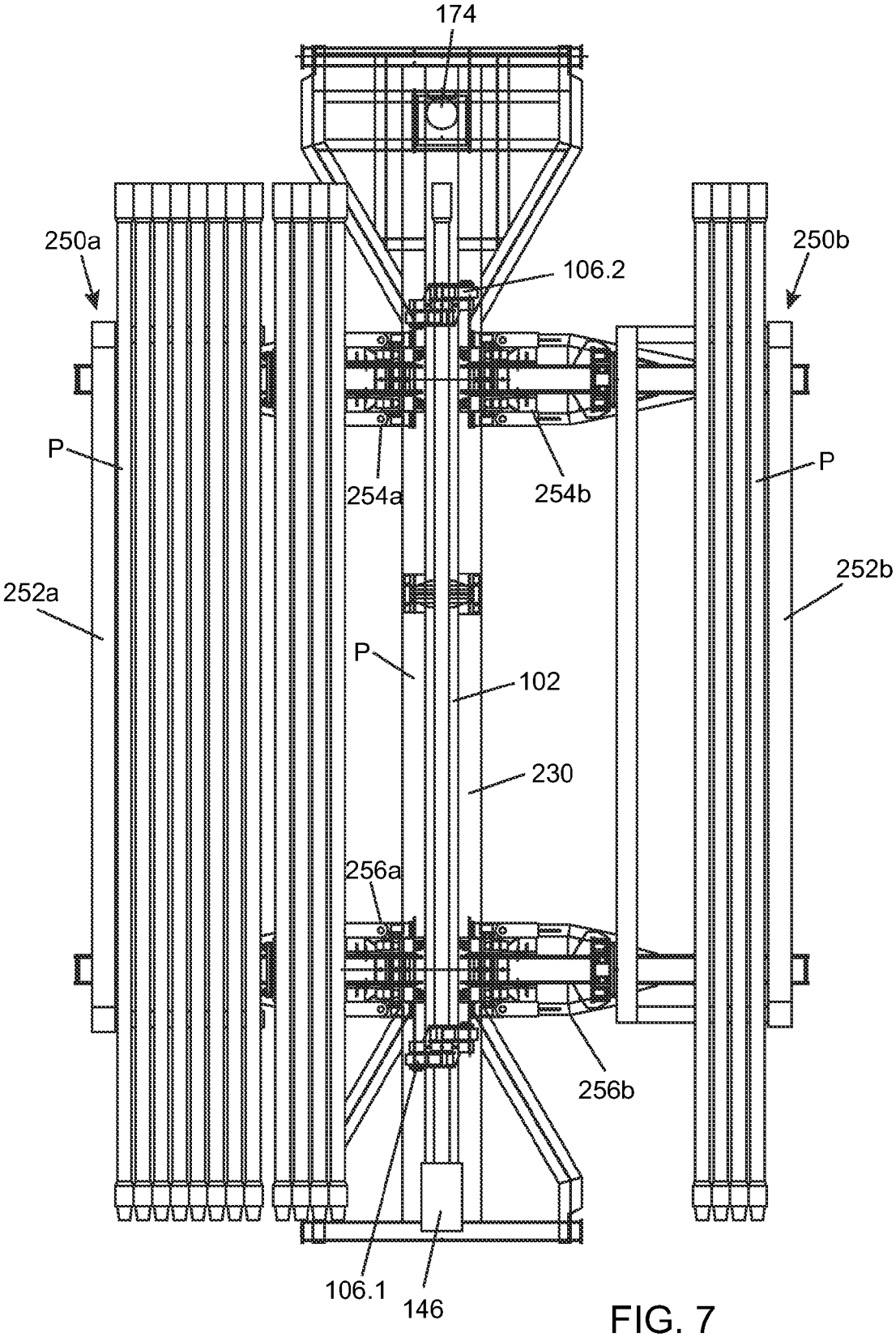
FIG. 7 shows an apparatus for servicing pipes with pipe loading and unloading systems.

FIG. 7 shows one embodiment where the pipe holder 102 is disposed between a pipe loading system **250*a* and a pipe unloading system 250*b*. The pipe loading system 250*a* is configured for supplying or transferring the pipe holder 102 with dirty pipes to be cleaned, e.g., pipes retrieved from a well, and the pipe unloading system 250*b* is configured for removing or transferring clean and lubricated pipes from the pipe holder 102**.

In one embodiment, the pipe loading system **250*a* includes a pipe storage assembly 252*a* and two pipe handling assemblies 254*a*, 256*a* disposed adjacent to the roller assemblies 106.1, 106.2, respectively. Similarly, in one embodiment, the pipe unloading system 250*b* includes a pipe storage assembly 252*b* and two pipe handling assemblies 254*b*, 256*b* disposed adjacent to the roller assemblies 106.1, 106.2**, respectively. The pipe storage and handling assemblies can have any suitable configuration, such as disclosed in U.S. Pat. No. 8,113,762 and U.S. Patent Application Publication No. 2007/0031215, the disclosures of which are incorporated herein by reference.

In one embodiment, as shown in FIG. **8*a*, the pipe storage assembly 252*a* has a pipe rack 258 and a pipe cartridge 278*a* supported on the pipe rack 258. The pipe cartridge 278*a* is made of a L-shaped frame 280, movable retainer(s) 282, and rungs 284. Each rung 284 can hold a plurality of pipes P. The pipe handling assembly 254*a* includes a stationary frame 270 and a tilting frame 271. One end of the tilting frame 271 is coupled to the stationary frame 270 via a pivot joint 272. Another end of the tilting frame 271 is coupled to the stationary frame 270 via an actuator 274. By extension or retraction of the actuator 274, the tilting frame 271 can be pivoted on the pivot joint 272. The tilting frame 271 is coupled to an elevation mechanism 276, which is coupled to the pipe rack 258. The tilting frame 271 can be tilted relative to the horizontal by rotating the tilting frame 271 about the pivot 272. The pipe rack 258 and pipe cartridge 278***a* will follow the orientation of the tilting frame 271 since they are coupled to the tilting frame 271 via the elevation mechanism 276.

The tilting frame 271 can be tilted to place the pipe cartridge 278*a* in a tilted orientation that will encourage pipes to roll off the pipe cartridge 278*a* onto the top of the tilting frame 271 by gravity. The elevation mechanism 276 is operable to move the pipe rack 258 relative to the tilting frame 271 such that a selected rung 284 of the pipe cartridge 278*a* can be positioned adjacent to the top of the tilting frame 271 where the pipes on that rung can roll onto the top of the tilting frame 271.

On top of the tilting frame 271 is an elevated stop 286*a*. Also, a lifting arm 288 is pivotally coupled to the tilting frame 271 at the upstream side of the elevated stop 286*a*. The lifting arm 288 is provided with an actuator 290, which can be operated to selectively raise the lifting arm 288 above the top of the tilting frame 271 or lower the lifting arm 288 below the top of the tilting frame 271. A pipe handling arm 292*a* is rotatively coupled to the frame 271 at the downstream side of the elevated stop 286*a*. A rotary motor 294 is provided to rotate the pipe handling arm 292*a* relative to the tilting frame 271 when needed.

Figure 8A:
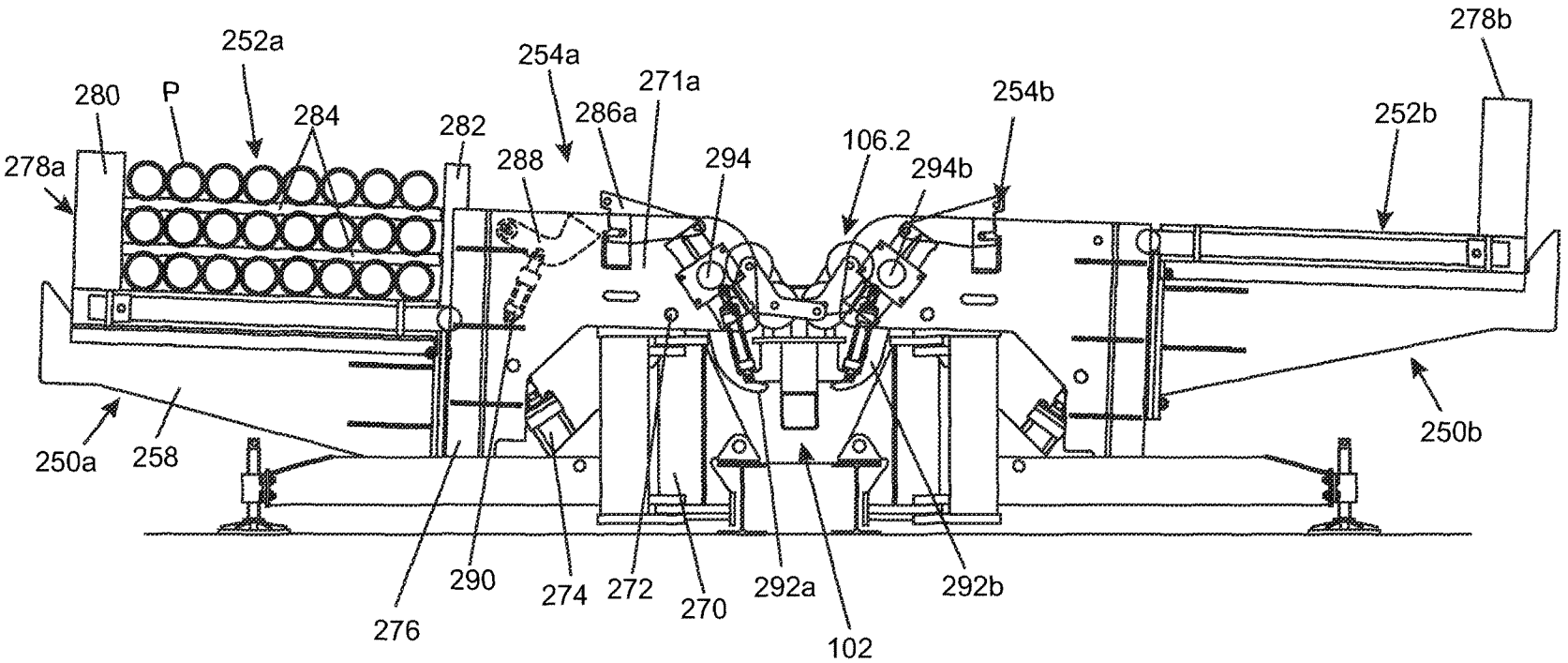
FIGS. 8*a*-8*d* illustrate a process for loading and unloading pipes from an apparatus for servicing pipes.
Figure 8B:
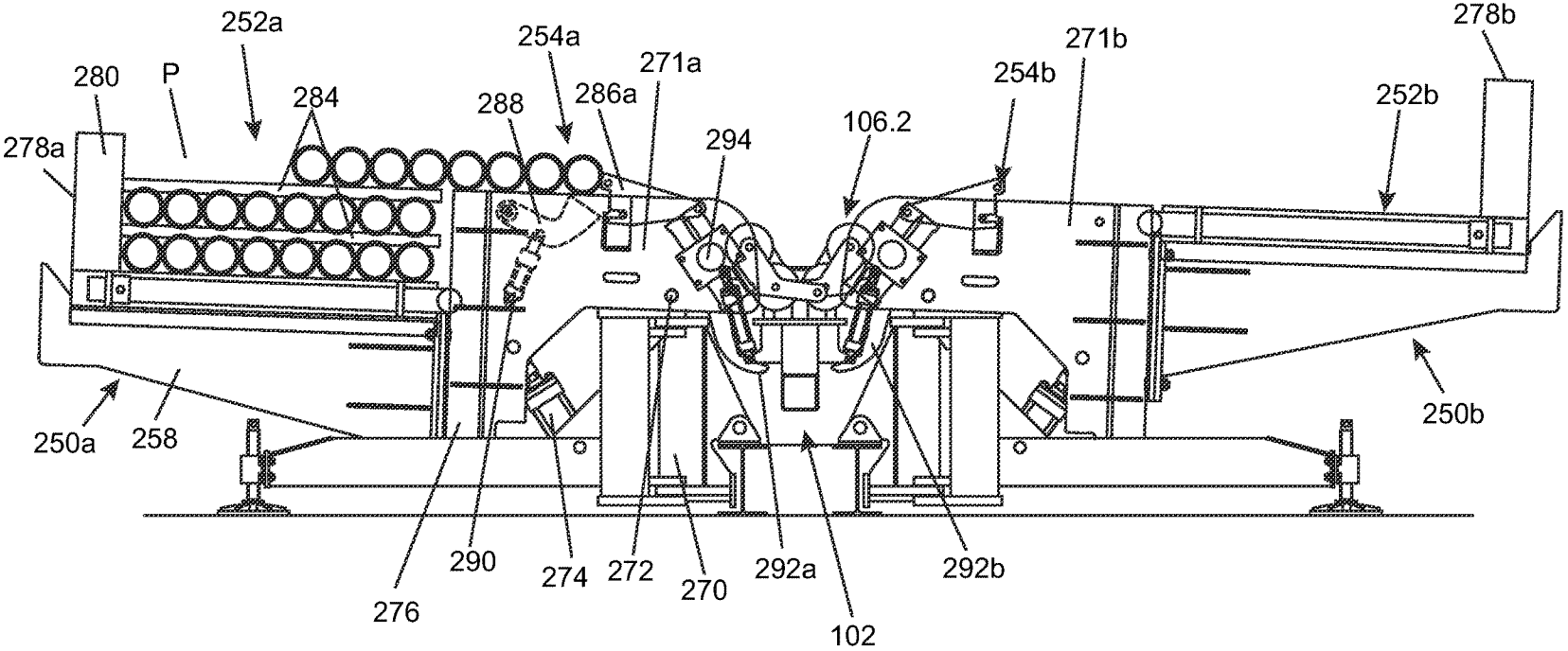

To move a pipe P from the pipe cartridge 278*a* onto the roller assemblies 106.1, 106.2 (see 106.1, 106.2 in FIG. 7), the elevated mechanism 276 is operated to align a selected rung 284 of the pipe cartridge 278*a* with the top of the tilting frame 271. Then, the tilting frame 271 is rotated about the pivot joint 272 so that pipes on the selected rung 284 can roll off the selected rung 284 onto the top of the tilting frame 271. The movable retainer 282 of the pipe cartridge 278*a* is then moved out of the way to allow the pipes from the selected rung 284 to roll onto the top of the tilting frame 271 and along the top of the tilting frame 271, by gravity, until they are backed up by the elevated stop 286*a*, as shown in FIG. 8*b*.

Figure 8C:
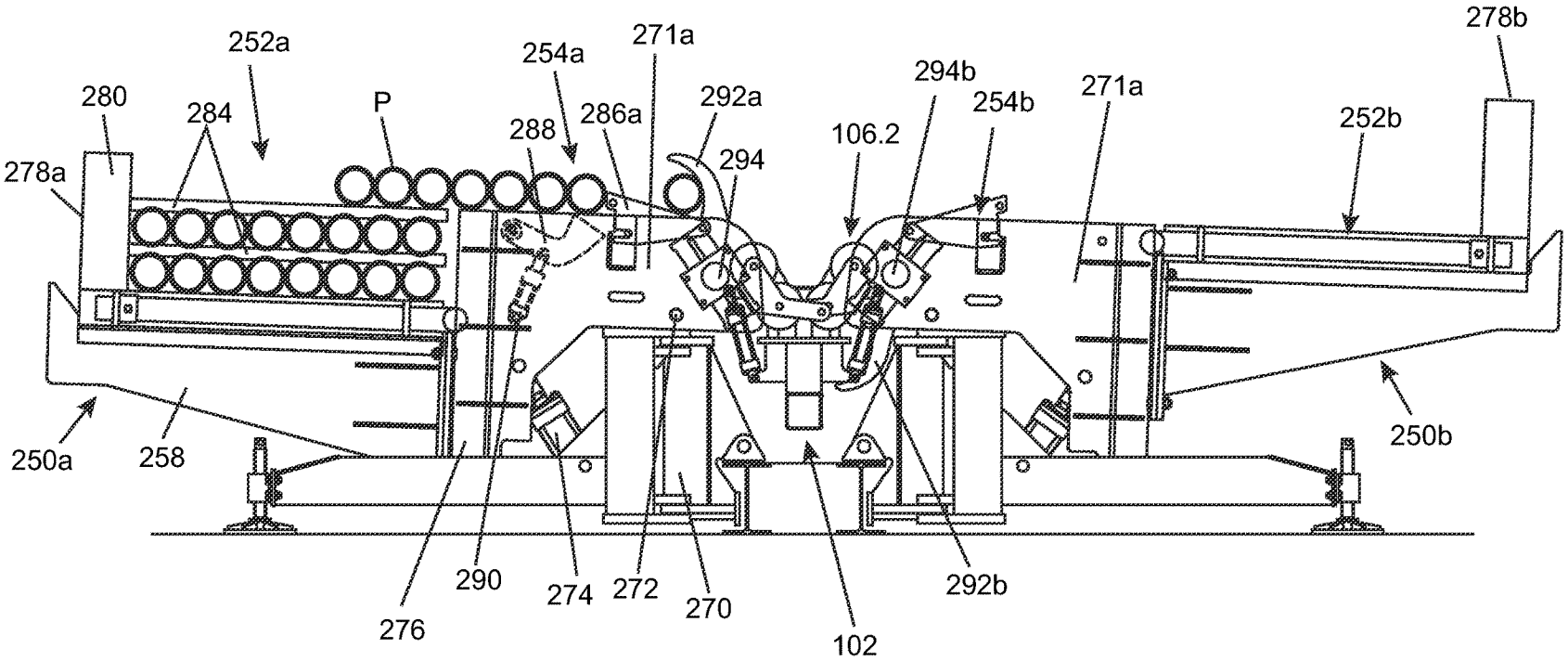
Figure 8D:
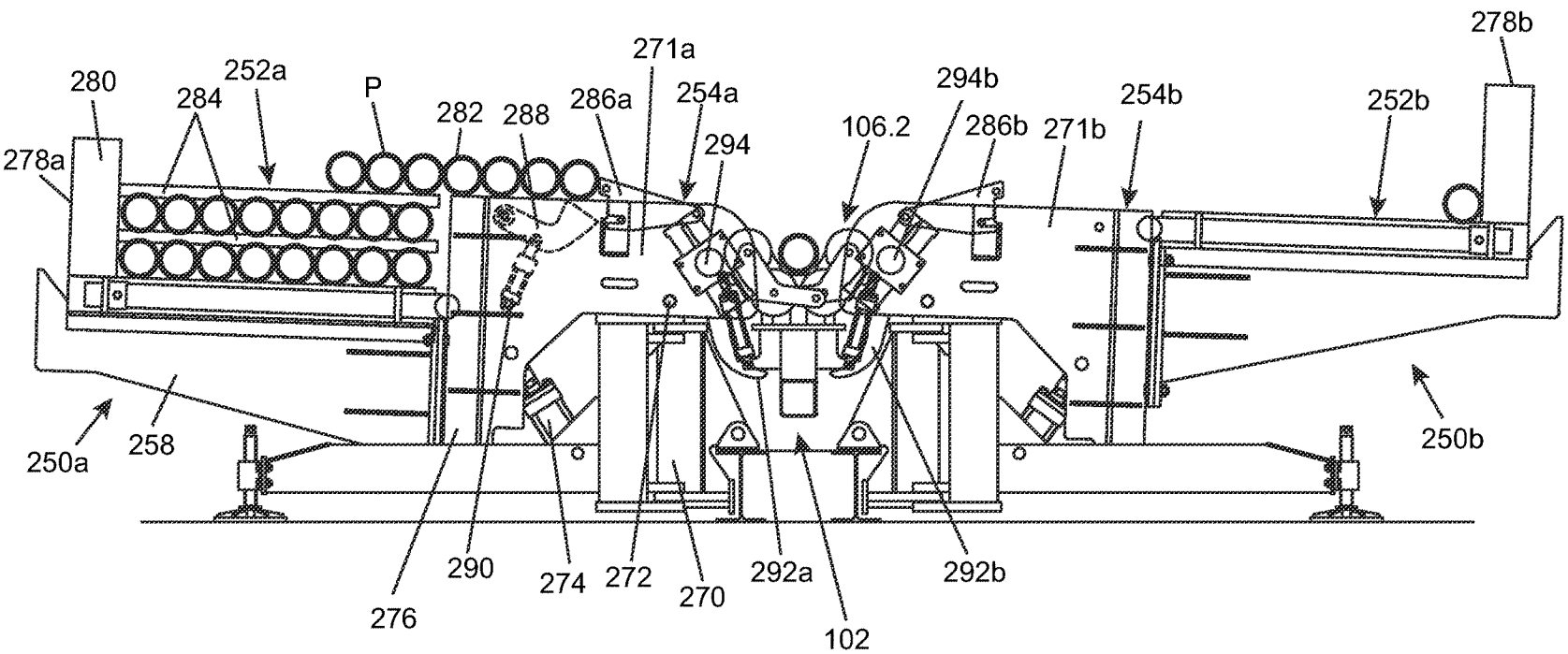

With the pipes backed up by the elevated stop 286*a*, the lifting arm 288 is raised to push a single pipe adjacent to the elevated stop 286*a* over the elevated stop 286*a*, where the pipe rolls down the elevated stop 286*a* until it reaches and is engaged by the pipe handling arm 292 near the end of the tilting frame 272, as shown in FIG. 8*c*. The rotary motor 294*a* rotates the pipe handling arm 292*a* until the pipe rolls off the pipe handling arm 292*a* onto the roller assemblies 106.1, 106.2 (see 106.1, 106.2 in FIG. 7), as shown in FIG. 8*d*. The pipe handling arm 292*a* continues to be rotated until it is out of the way. The pipe handling arm 292*a* can be further rotated until it is above the tilting frame 271, where it can again engage a pipe moving over and past the elevated stop 286*a*.

In one embodiment, the pipe storage assembly 252*b* is similar to the pipe storage assembly 252*a*, and the pipe handling assembly 254*b* is similar to the pipe handling assembly 254*a*. To unload a pipe P from the roller assemblies 106.1, 106.2 (see 106.1, 106.2 in FIG. 7), the rotary motor 294*b* of the pipe handling assembly 254*b* rotates the pipe handling arm 294*b* of the pipe handling assembly 254*b* until the pipe handling arm 294*b* engages the pipe on the roller assemblies 106.1, 106.2. Further rotation of the pipe handling arm 294*b* will lift the pipe onto the top of the tilting frame 271*b* of the pipe handling assembly 254*b*. The elevated stop 286*b* will be retracted so that the pipe can roll off to the pipe cartridge 278*b* of the pipe storage assembly 252*b* under the influence of gravity. After the pipe has rolled off to the pipe cartridge 278*b*, the elevated stop 286*b* can be raised so that pipes do not roll back from the pipe cartridge 278*b* onto the roller assemblies 106.1, 106.2.

During tripping, dirty pipes removed from the well can be arranged in the pipe cartridge 278*a*, which can then be placed on the pipe rack 258 adjacent to the pipe holder 102. The apparatus 100 can be at a location, such as away from the well center, where space constraint is not too concerning and cleaning and lubrication can be performed efficiently. After the pipes are cleaned and lubricated using the apparatus 100, the clean and lubricated pipes can be stored in the pipe cartridge 278*b* for later use at the well center. The clean and lubrication pipes can be tripped into the well without having to wait after each new pipe connection is made up for the next pipe to be cleaned and lubricated. Means other than a pipe cartridge system, such as a forklift, can be used to load and unload a pipe from the pipe holder 102 of the apparatus 100.

EXAMPLE 1

The apparatus 100 is used in tripping out during a drilling operation according to the steps shown below:

1.1 Suspend drill string in slips
1.2 Pick up the drill string with an elevator and lift the drill string until a dirty pipe at the top of the drill string is above the slips
1.3 Close the slips
1.4 Break out the dirty pipe from the drill string using an iron roughneck
1.5 Pick up the dirty pipe with a pipe handling system and disconnect the elevator
1.6 Move the dirty pipe to a horizontal position on the ground using the pipe handling system
1.7 Pick the dirty pipe from the horizontal position using a forklift and move the dirty pipe to the servicing apparatus
1.8 Operate the servicing apparatus to clean and lubricate the dirty pipe
1.9 Pick up the clean and lubricated pipe from the servicing apparatus using a forklift and move the clean and lubricated pipe to a horizontal rack on the ground
1.10 Repeat 1.2 to 1.9 as needed

EXAMPLE 2

The apparatus 100 is used in tripping out during a drilling operation according to the steps shown below:

2.1 Suspend drill string in slips
2.2 Pick up the drill string with an elevator and lift the drill string until a dirty pipe at the top of the drill string is above the slips
2.3 Close the slips
2.4 Break out the dirty pipe from the drill string using an iron roughneck
2.5 Pick up the dirty pipe with a pipe handling system and move the dirty pipe to a horizontal position on the ground
2.6 Move the dirty pipe into a pipe cartridge using a cartridge loading system
2.7 Repeat 2.1 to 2.6 until the pipe cartridge is full with dirty pipes (optionally disconnect the elevator)

2.8 Pick up the pipe cartridge with dirty pipes with a forklift and move the pipe cartridge into a pipe loading system associated with the servicing apparatus
2.9 Operate the pipe loading system to load a dirty pipe into the servicing apparatus
2.10 Operate the servicing apparatus to clean the dirty pipe
2.11 Operate a pipe unloading system associated with the servicing apparatus to unload the clean and lubricated pipe from the servicing apparatus to another pipe cartridge
2.12 Repeat 2.9 to 2.11 until all the dirty pipes have been cleaned and lubricated
2.13 Pick up the pipe cartridge with the clean and lubricated pipes from the pipe unloading system and place the pipe cartridge in a storage area for later use

EXAMPLE 3

The apparatus 100 is used in tripping in during a drilling operation according to the steps shown below:

3.1 Clean and lubricated pipes are stored in a horizontal position on a horizontal rack on the ground (from Example 1)
3.2 Suspend drill string in slips
3.3 Move the clean and lubricated pipes onto a pipe handling system using a forklift
3.4 Move a clean and lubricated pipe to the well center using the pipe handling system
3.5 Pick up the clean and lubricated pipe using and elevator and stab the pipe into a box at the top of the drill string
3.6 Make up the connection between the pipe and box using an iron roughneck
3.7 Lift the drill string using the elevator—slips will open
3.8 Move the drill string into the well until the pipe is just above the slips—slips will close
3.9 Disconnect the elevator from the pipe
3.10 Repeat 3.3 to 3.9 as needed

EXAMPLE 4

The apparatus 100 is used in tripping in during a drilling operation according to the steps shown below:

4.1 Pipe cartridge with clean and lubricated pipes is in a storage area (from Example 2)
4.2 Suspend drill string in slips
4.3 Move the pipe cartridge to a cartridge loading system using a forklift
4.4 Move a clean and lubricated pipe from the pipe cartridge to a pipe handling system using the cartridge loading system
4.5 Move the clean and lubricated pipe to the well center using the pipe handling system
Pick up the clean and lubricated pipe using an elevator and stab the pipe into a box at the top of the drill string
4.6 Make up the connection between the pipe and box using an iron roughneck
4.7 Lift the drill string using the elevator—slips will open
4.8 Move the drill string into the well until the pipe is just above the slips—slips will close
4.9 Disconnect the elevator from the pipe
4.10 Repeat 4.4 to 4.9 as needed Referring to FIGS. 9*a*-9*e*, another embodiment of a pipe servicing or cleaning tool 346 of an apparatus 300 for servicing pipes is shown. In this embodiment, apparatus 300 is similar to apparatus 100 of FIGS. 1-8*d*, but for the inclusion of cleaning tool 346 in lieu of cleaning tool 146 of apparatus 100. Similar to cleaning tool 146, cleaning tool 346 is disposed proximate to one end of the pipe holder 102 and is mounted at the end of the support arm 104 near the roller assembly 106.1, with tool 346 aligned with assembly 106.1. Thus the cleaning tool 346 will be able to perform a cleaning service on an end of the pipe P while the pipe P is supported and engaged by the roller assemblies 106.1, 106.2. In this manner, the cleaning tool 346 is operably engaged with an end of the pipe P.

In this embodiment, cleaning tool 346 includes a conductivity tester 350 configured to test the conductivity of an annular conductor 50 disposed at pin PP of pipe P, and an associated electrical wire 52 connected to annular conductor 50. Conductivity tester 350 generally includes electrical leads 351, a linear actuator 352 coupled to bracket 152 at a ball joint 353. To enhance stability of tester 350 during operation, a spring 354 is coupled between the linear actuator 352 and bracket 152. Actuator 352 includes a retractable shaft 356 that extends and retracts during operation. An annular conductor 358 is coupled to the terminal end of shaft 356 and is configured to physically engage and electrically couple with the annular conductor 50 of pipe P. In this manner, the conductivity tester 350 is operably engaged with an end of the pipe P.

While cleaning tool 346 of apparatus 300 has been described as including conductivity tester 350, in other embodiments the cleaning tool of apparatus 300 may incorporate other conductivity tester embodiments. For instance, the conductivity testers described in U.S. Provisional Application No. 61/859,767, entitled "Movement Compensating Testing Systems and Apparatuses," herein incorporated by reference in its entirety, may also be used in cleaning tool 346. Further, the conductivity testers described in U.S. Provisional Application No. 61/807,676, entitled "Tubular Coupling Systems and Apparatuses," herein incorporated by reference in its entirety, may also be used.

In order to protect the conductivity tester 350 from a collision with pipe P while allowing annular conductor 358 to extend into and physically contact annular conduct 50, cleaning tool includes a rotatable protective shield 360. In this embodiment, shield 360 generally includes a rotary actuator 362, a shield or mechanical stop 364 and a shaft 366 that couples actuator 362 to stop 364. Stop 364 has a first or vertical position shown in FIGS. 9*a*-9*c* and a second or horizontal position shown in FIGS. 9*d* and 9*e*. In this embodiment, when stop 364 is in the first position it is disposed between the pin PP of pipe P and the conductivity tester 350 such that pin PP is positioned to contact or engage stop 364. When stop 364 is in the second position clearance is provided such that annular conductor 358 is able to extend into pin PP and contact annular conductor 50 of pipe P. In this manner, the conductivity tester 350 is operably engaged with the pin PP of the pipe P. Stop 364 may be actuated between the first and second positions via rotary actuator 362, which is configured to rotate shaft 356 during actuation, causing stop 364 to rotate between the first and second positions.

Figure 9A:
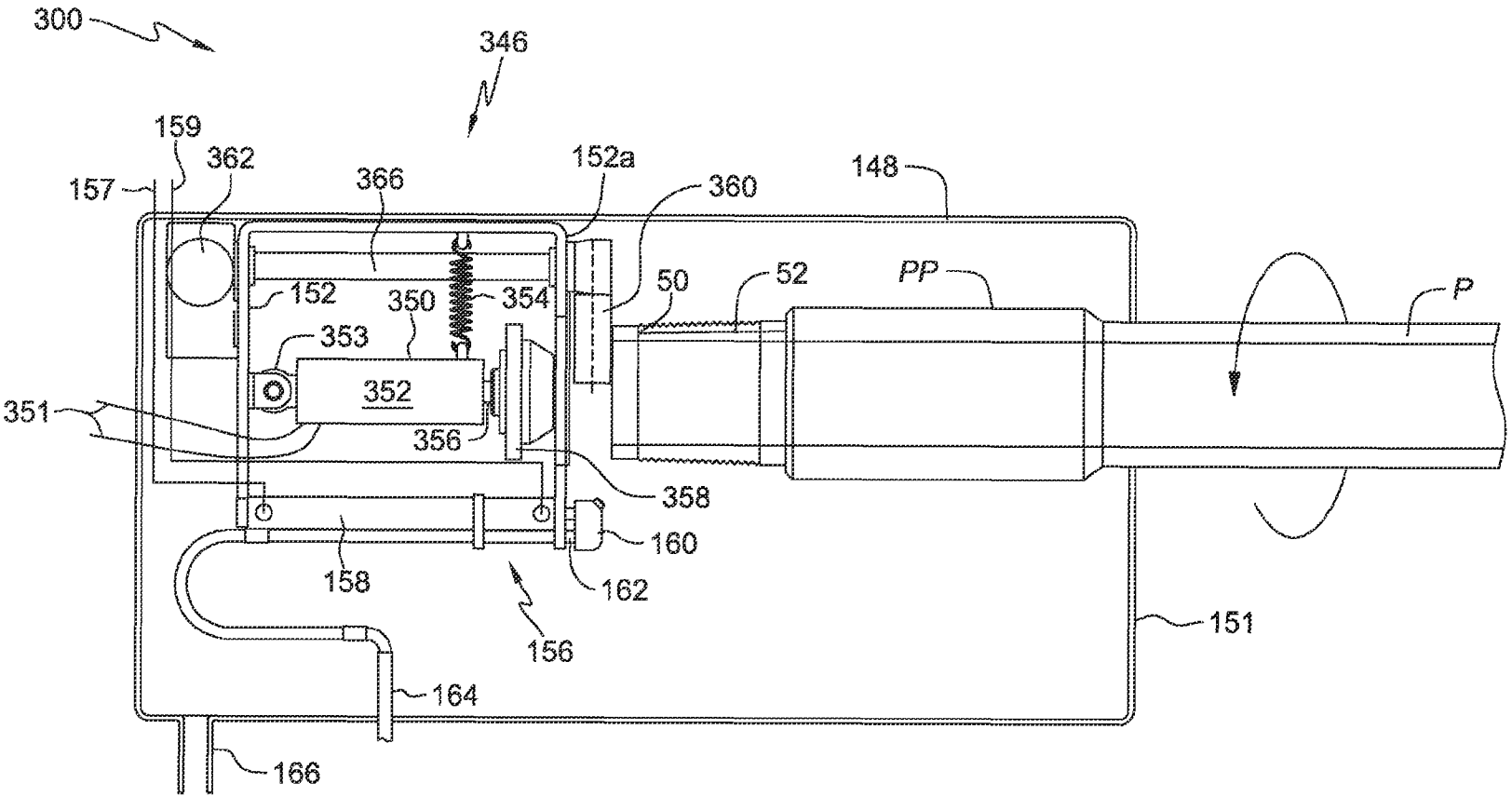
FIGS. 9*a*-9*e* show another embodiment of a cleaning tool of an apparatus for servicing pipes in accordance with principles disclosed herein.
Figure 9B:
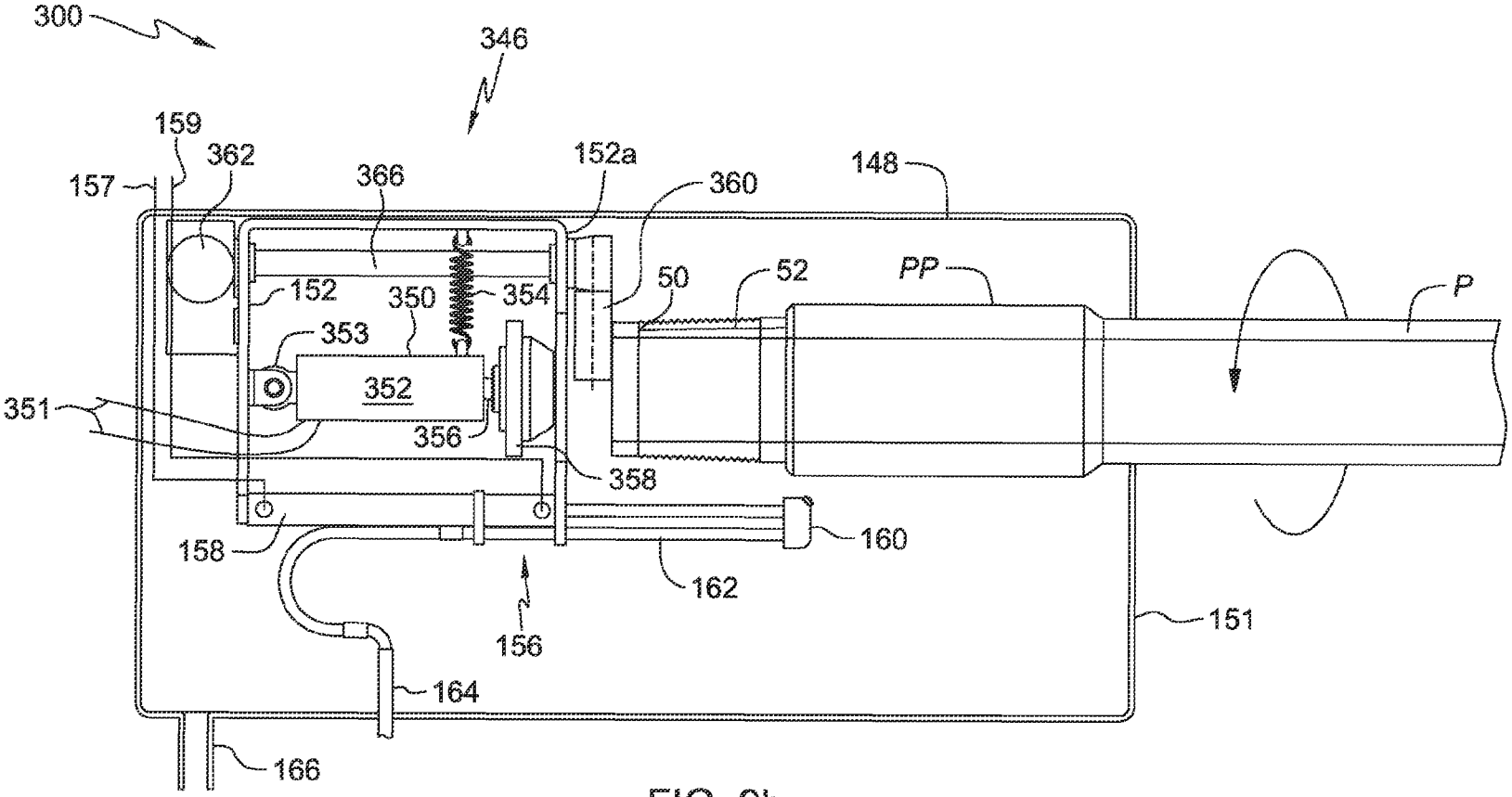
Figure 9C:
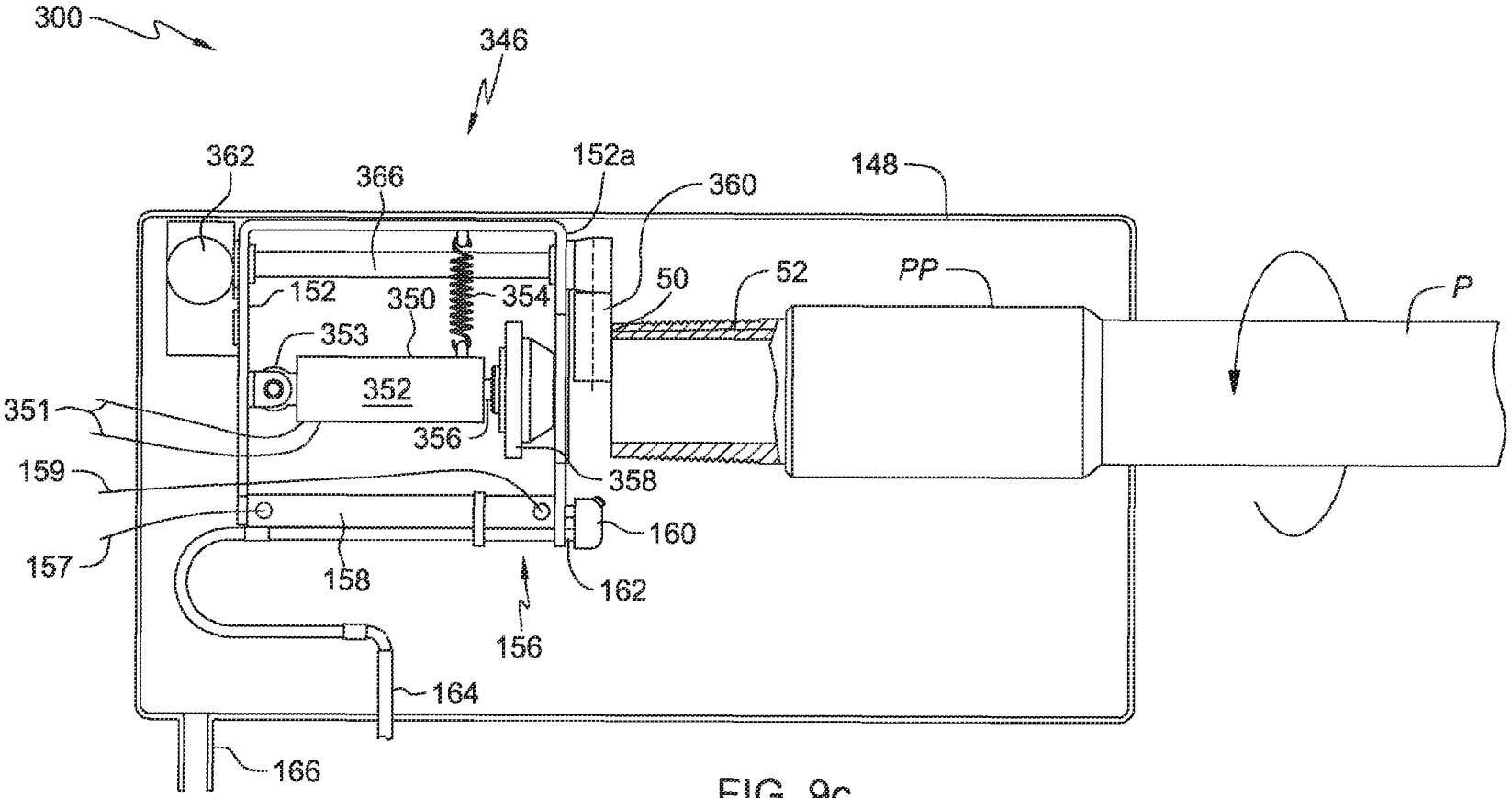

In this embodiment, cleaning tool 346 may be operated in the manner shown in the sequence of figures spanning from FIG. 3*a* to FIG. 3*e*. For instance, as shown in FIGS. 9*a* and 9*b*, with stop 364 in the first position the pin PP of pipe P is cleaned via nozzle assembly 156 prior to conductivity testing by conductivity tester 350. Cleaning of pin PP by nozzle assembly 156 may be conducted in a manner consistent with the methodology described in reference to FIGS.

Figure 9D:
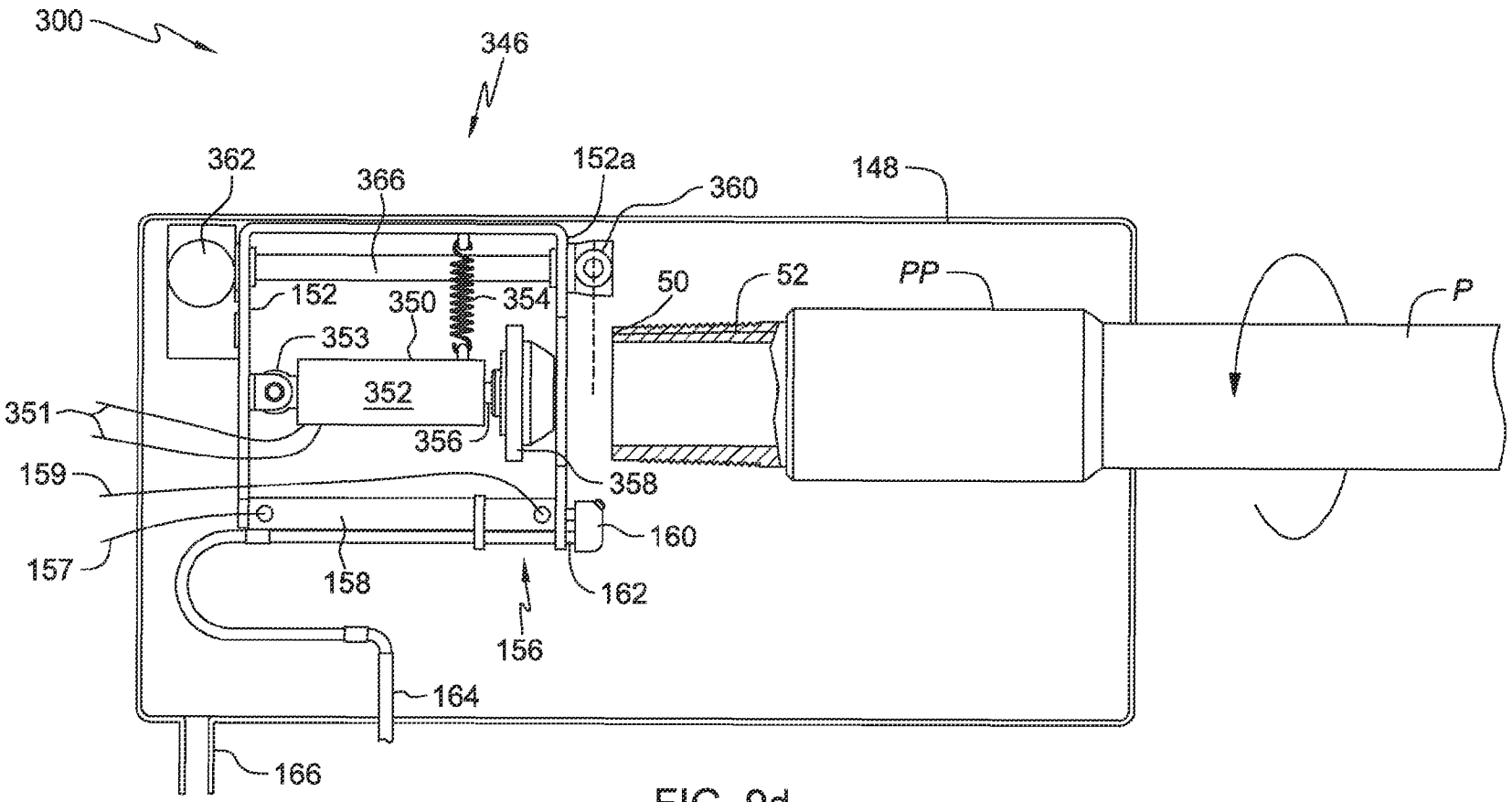
Figure 9E:
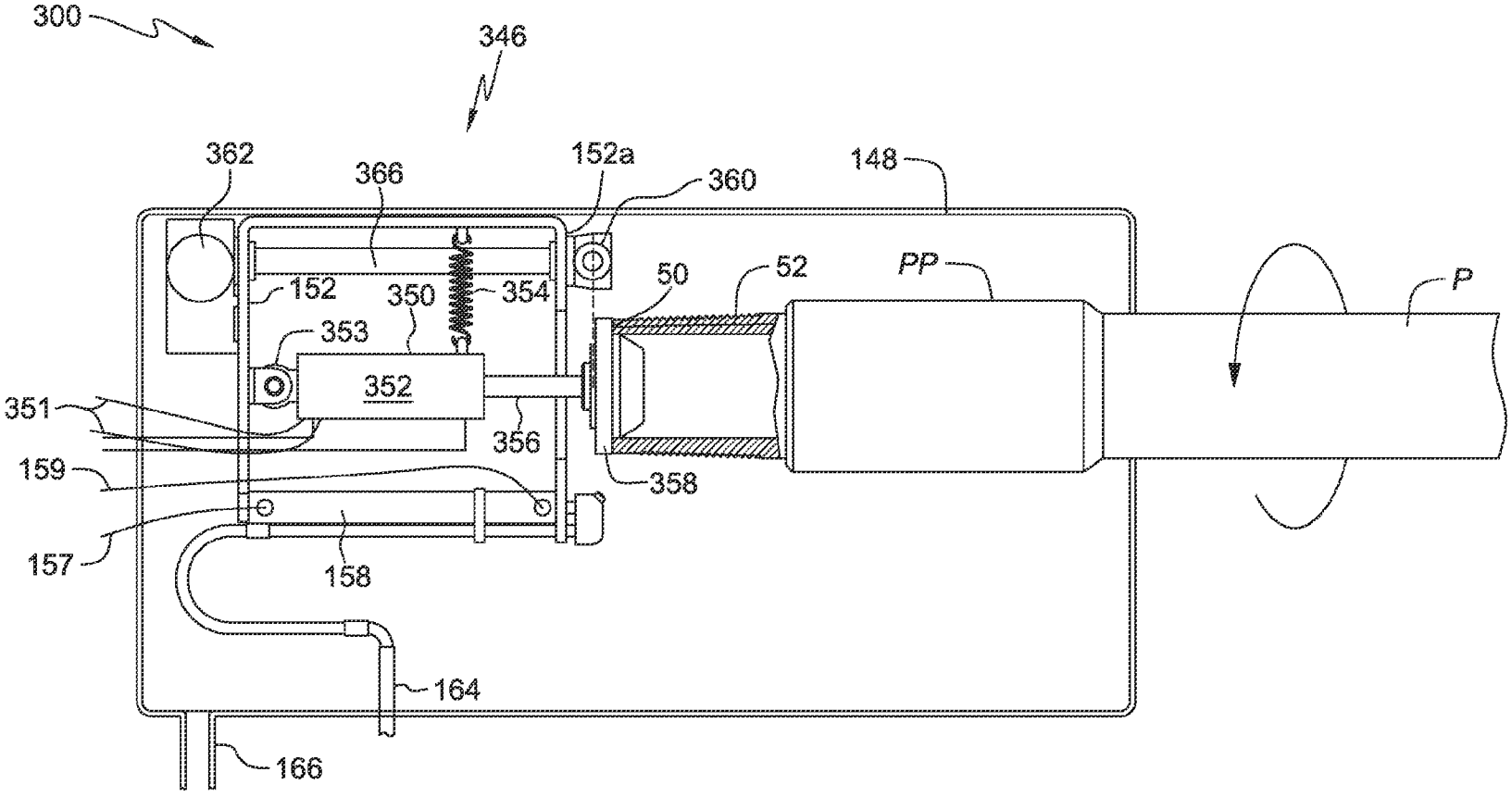

3*a* and 3*b*. Following cleaning, stop 364 may be rotated from the first position to the second position via rotary actuator 362 (FIG. 9*d*). Following this, the annular conductor 358 is extended towards pin PP of pipe P until it engages annular conductor 50 of pin PP (FIG. 9*e*).

Figure 10A:
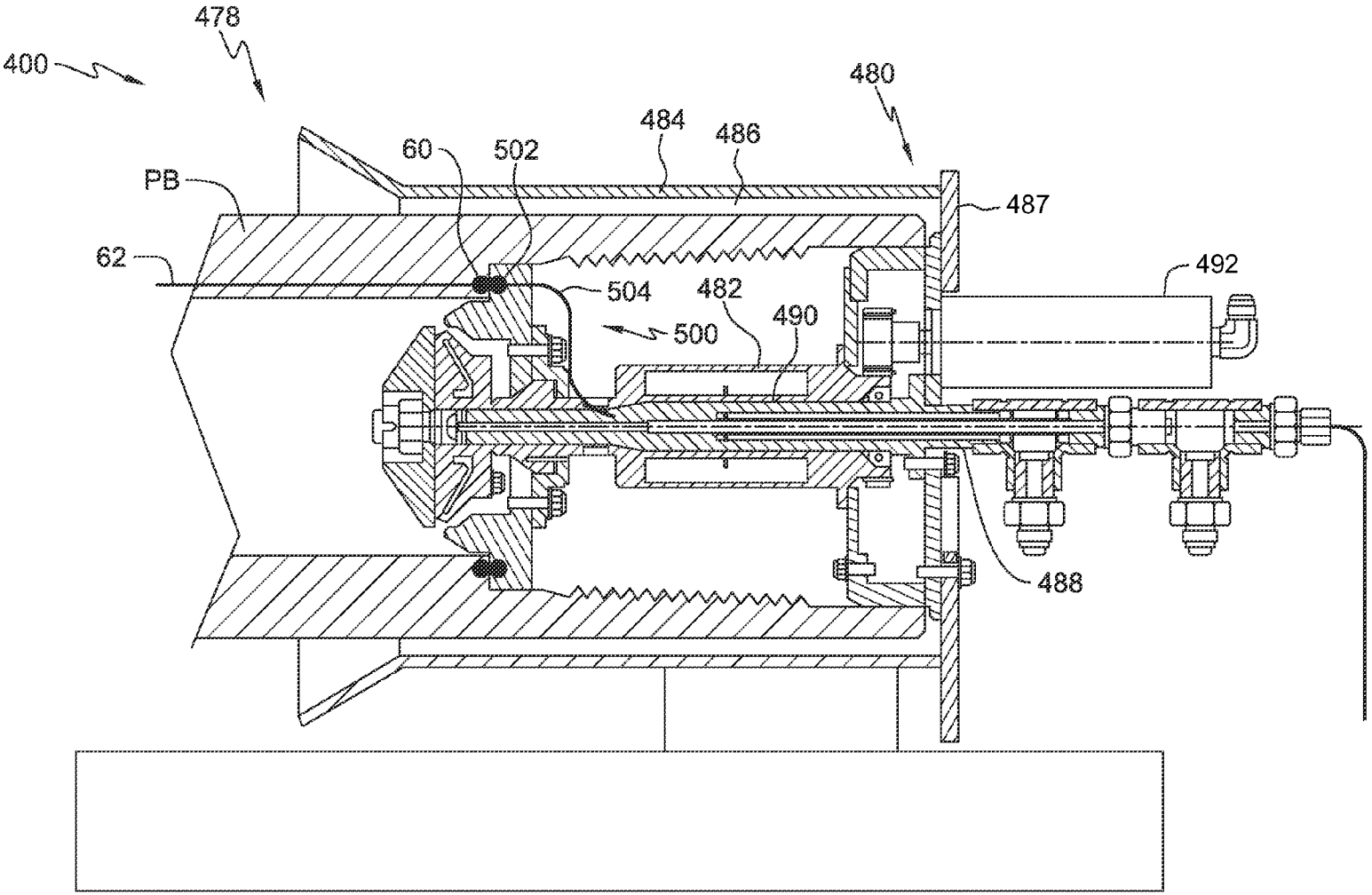
FIGS. 10*a* and 10*b* show another embodiment of a lubrication tool of an apparatus for servicing pipes in accordance with principles disclosed herein.
Figure 10B:
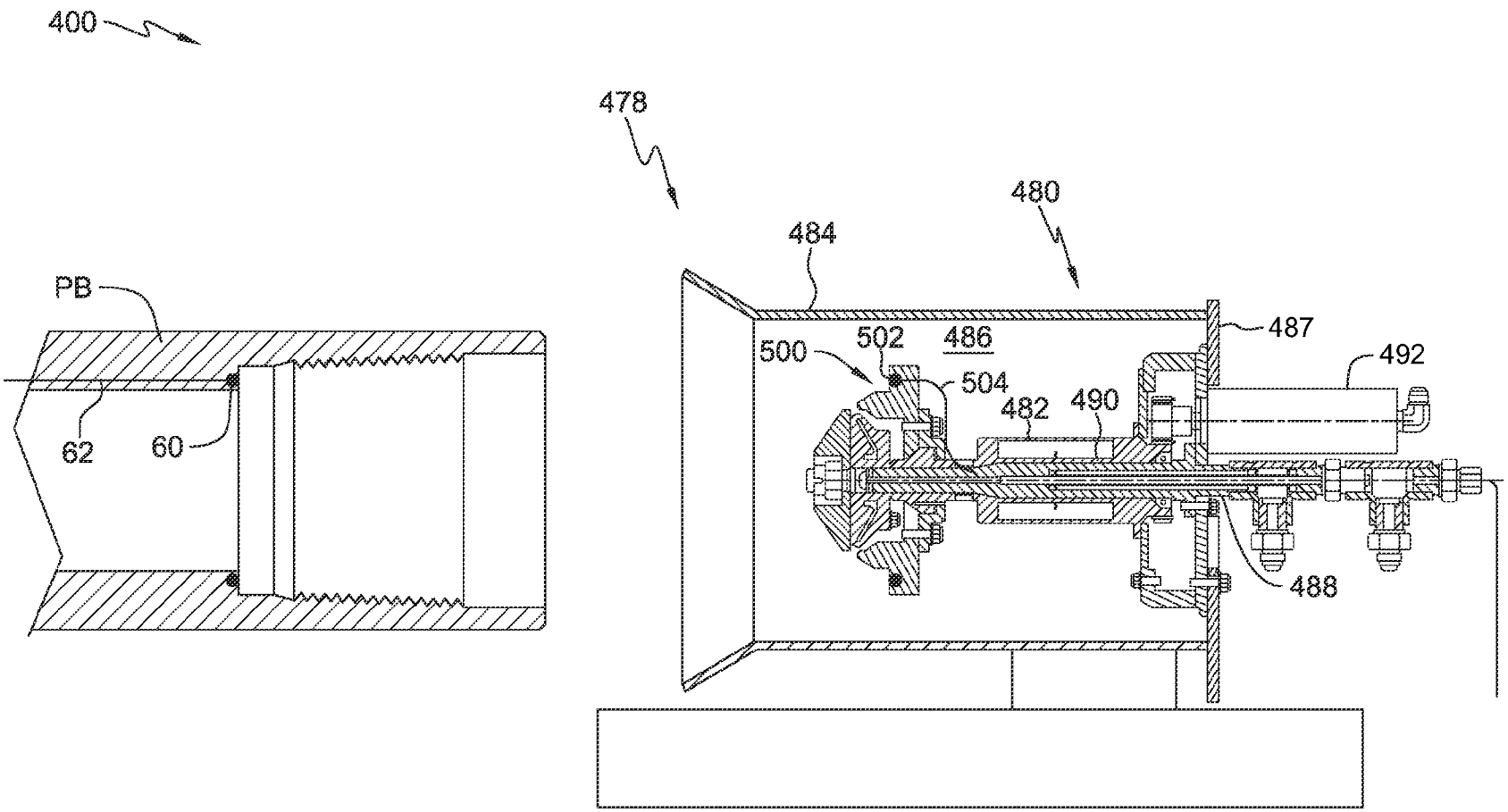

Referring to FIGS. 10*a* and 10*b*, another embodiment of a pipe servicing or combination tool 478 of an apparatus 400 for servicing pipes is shown. In this embodiment, apparatus 400 is similar to apparatus 100 of FIGS. 1-8*d*, but for the inclusion of combination tool 478 in lieu of lubrication tool 178 of apparatus 100. Combination tool 478 generally includes a lubricator 480 and a conductivity tester 500. Lubricator 480 includes features that are similar to those of lubrication tool 178. For instance, lubricator 480 generally includes a drum 482 disposed inside of a generally cylindrical housing 484, forming an annulus 486. Lubricator 480 also includes a cap 487 at one end of housing 484 that includes a conduit 488 that extends into the inside of drum 482. Conduit 488 includes a shaft 490 that is coupled to a rotary actuator 492 for driving the drum 482 such that lubricant may be evenly applied to the threads of pipe box PB of pipe P. In this manner, the lubricator 480 is operably engaged with the box PB of the pipe P when lubricant is being applied to threads of pipe box PB.

In this embodiment, conductivity tester 500 is configured to test the conductivity of an annular conductor 60 disposed at pipe box PB of P, and an associated electrical wire 62 connected to annular conductor 60. Conductivity tester 500 generally includes an annular conductor 502 coupled at a second or lower end of shaft 490 and electrical leads 504 that extend through shaft 490. During operation the lubricator 480 and conductivity tester 500 may be actuated concurrently to reduce the time required to complete both tasks. However, in other embodiments lubricator 480 may be actuated before or after conductivity testing is performed by conductivity tester 500 Annular conductor 502 of conductivity tester 500 is configured to physically engage and electrically couple with the annular conductor 60 at pipe box PB of pipe P. In this manner, the conductivity tester 500 is operably engaged with the box PB of the pipe P.

Although combination tool 478 of apparatus 400 has been described as including conductivity tester 500, in other embodiments the cleaning tool of apparatus 400 may incorporate other conductivity tester embodiments. For instance, the conductivity testers described in U.S. Provisional Application No. 61/859,767, entitled "Movement Compensating Testing Systems and Apparatuses," herein incorporated by reference in its entirety, may also be used in combination tool 478. Further, the conductivity testers described in U.S. Provisional Application No. 61/807,676, entitled "Tubular Coupling Systems and Apparatuses," herein incorporated by reference in its entirety, may also be used.

While cleaning tool 346 and combination tool 478 have been described as belong to different embodiments (i.e., apparatuses 300 and 400), in other embodiments an apparatus for servicing a pipe may include both the cleaning tool 346 and the combination tool 478.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. An apparatus for servicing pipes, comprising:

a pipe holder comprising:

a frame configured to support the pipe; and a movement assembly coupled to the frame and configured to rotate the pipe about a longitudinal axis of the pipe;

a first pipe servicing tool comprising a container disposed proximate to an end of the pipe holder, wherein the first pipe servicing tool is configured to operably engage an end of the pipe with the end of the pipe received within a chamber of the container when the pipe is rotated by the movement assembly;

a first actuator coupled to the pipe holder and configured to selectively move the pipe holder between a horizontal position and an inclined position, and hold the pipe holder in the inclined position as the first pipe servicing tool operably engages the end of the pipe with the end of the pipe received within the chamber of the container; and a second actuator coupled to the pipe holder and configured to selectively move the pipe along a longitudinal axis of the pipe into operable engagement with the first pipe servicing tool.

2. The apparatus of claim 1, wherein the first pipe servicing tool comprises a cleaning tool configured to deliver a cleaning fluid to an end of the pipe.

3. The apparatus of claim 2, wherein the cleaning tool comprises:

a nozzle coupled to an end of a retractable arm, wherein the nozzle is configured to apply a fluid to a surface of the pipe; and a third actuator coupled to the arm and configured to extend and retract the arm.

4. The apparatus of claim 1, wherein the first pipe servicing tool comprises a lubrication tool configured to deliver lubricant to an end of the pipe.

5. The apparatus of claim 1, wherein the first pipe servicing tool comprises a conductivity tester configured to test the conductivity of a conductor of the pipe.

6. The apparatus of claim 5, wherein the conductivity tester comprises:

a third actuator coupled to a retractable shaft and configured to extend and retract the shaft;

a conductor coupled to an end of the shaft and configured to engage a conductor of the pipe; and a shield configured to protect the conductivity tester from a collision with the pipe.

7. The apparatus of claim 6, wherein the shield is rotatable between a first position and a second position, wherein in the first position the shield is arranged to contact the pipe and wherein in the second position the shield is arranged to allow the conductor to engage the pipe.

8. The apparatus of claim 1, wherein the first pipe servicing tool comprises a combination tool configured to lubricate the pipe and test the conductivity of a conductor of the pipe.

9. The apparatus of claim 8, wherein the combination tool comprises:

a rotary actuator coupled to a first end of a shaft, wherein the rotary actuator is configured to rotate the shaft;

a conductor coupled to a second end of the shaft, wherein the conductor is configured to contact a conductor of the pipe; and an electrical lead connected to the annular conductor and extending through the conduit of the shaft.

10. The apparatus of claim 1 further comprising a second pipe servicing tool disposed proximal to the opposite end of the pipe from the first pipe servicing tool.

11. The apparatus of claim 10, wherein the second pipe servicing tool is selected from the group consisting of a cleaning tool, a lubrication tool and a combination tool.

12. An apparatus for servicing pipes, comprising:

a pipe holder comprising:

a frame configured to support the pipe; and a movement assembly coupled to the frame configured to manipulate the pipe;

a first pipe servicing tool disposed proximate to an end of the pipe holder and configured to operably engage an end of the pipe;

wherein the first pipe servicing tool and the movement assembly are configured to provide relative movement between the first pipe servicing tool and the pipe;

a first actuator coupled to the pipe holder and configured to selectively move the pipe holder between a horizontal position and an inclined position, and hold the pipe holder in the inclined position as the first pipe servicing tool operably engages the end of the pipe; and a second actuator coupled to the pipe holder and configured to selectively move the pipe along a longitudinal axis of the pipe into operable engagement with the first pipe servicing tool.

13. The apparatus of claim 12, wherein the first pipe servicing tool and the movement assembly are configured to provide relative rotational movement between the first pipe servicing tool and the pipe.

14. The apparatus of claim 12, wherein the first pipe servicing tool and the movement assembly are configured to provide relative axial movement between the first pipe servicing tool and the pipe.

15. The apparatus of claim 14, wherein the cleaning tool comprises:

a nozzle coupled to an end of a retractable arm, wherein the nozzle is configured to apply a fluid to a surface of the pipe; and a third actuator coupled to the arm and configured to extend and retract the arm.

16. The apparatus of claim 12, wherein the first pipe servicing tool comprises a conductivity tester configured to test the conductivity of a conductor of the pipe.

17. The apparatus of claim 16, wherein the conductivity tester comprises:

a third actuator coupled to a retractable shaft and configured to extend and retract the shaft;

a conductor coupled to an end of the shaft and configured to engage a conductor of the pipe; and a shield configured to protect the conductivity tester from a collision with the pipe.

18. The apparatus of claim 17, wherein the shield is rotatable between a first position and a second position, wherein in the first position the shield is arranged to contact the pipe and wherein in the second position the shield is arranged to allow the conductor to engage the pipe.

19. The apparatus of claim 12, wherein the first pipe servicing tool comprises a combination tool configured to lubricate the pipe and test the conductivity of a conductor of the pipe.

20. The apparatus of claim 19, wherein the combination tool comprises:

a rotary actuator coupled to a first end of a shaft, wherein the rotary actuator is configured to rotate the shaft;

a conductor coupled to a second end of the shaft, wherein the conductor is configured to contact a conductor of the pipe; and an electrical lead connected to the annular conductor and extending through the conduit of the shaft.

21. The apparatus of claim 12, wherein the second actuator is configured to move the pipe along its longitudinal axis while the pipe holder is disposed in the inclined position.

22. A method of using the apparatus of claim 1 for servicing pipes, comprising:

supporting a pipe in one of a horizontal position and an inclined position;

moving the pipe between the horizontal and inclined positions;

disposing a pipe servicing tool proximal to an end of the pipe;

moving the pipe along a longitudinal axis of the pipe into operable engagement with the pipe servicing tool;

operating the pipe servicing tool to perform a servicing at an end of the pipe, the servicing being selected from the group consisting of delivering a fluid to the end of the pipe and testing the conductivity of a conductor of the pipe; and holding the pipe in the inclined position as the pipe servicing tool performs the servicing at the end of the pipe.

23. The method of claim 22, further comprising transferring a pipe from a pipe storage system to a roller assembly via pivoting the pipe storage system relative to the roller assembly.

* * * * *